US012501956B1

(12) United States Patent
Delerme

(10) Patent No.: US 12,501,956 B1
(45) Date of Patent: Dec. 23, 2025

(54) WEARABLE BRIM SHAPER FOR A BALL CAP

(71) Applicant: Nelson Delerme, Bronx, NY (US)

(72) Inventor: Nelson Delerme, Bronx, NY (US)

( * ) Notice: Subject to any disclaimer, the term of this patent is extended or adjusted under 35 U.S.C. 154(b) by 0 days.

(21) Appl. No.: 19/084,742

(22) Filed: Mar. 19, 2025

(51) Int. Cl.
*A42B 1/002* (2021.01)

(52) U.S. Cl.
CPC ..... *A42B 1/002* (2013.01)

(58) Field of Classification Search
CPC ..... A42B 1/002; A42B 1/004; A42B 1/247; A42B 1/18; A42B 1/0184; A42B 1/0185; A42B 1/24; A42B 1/248; A42C 3/00; A42C 1/06; B65D 85/18; A47G 25/10; D06F 95/008; D06F 59/02
See application file for complete search history.

(56) References Cited

U.S. PATENT DOCUMENTS 1,955,232 A * 4/1934 Gallaway ..... G02C 3/02 2/10
2,138,086 A * 11/1938 Blodjer ..... A42B 1/0184 2/10
3,035,270 A * 5/1962 Boerner ..... A42B 1/0181 2/10
5,163,589 A 11/1992 Biehl
5,244,102 A * 9/1993 Koenig ..... A47G 25/10 211/32
5,533,652 A 7/1996 Levin
5,544,361 A * 8/1996 Fine ..... A42B 1/0181 2/454
D377,108 S * 1/1997 Schulz ..... D2/893
5,701,607 A * 12/1997 Kaiser ..... A42B 1/248 40/329
5,862,522 A * 1/1999 Cho ..... A42C 1/06 223/51
5,865,333 A * 2/1999 Wolfe ..... A45C 11/02 206/8

(Continued)

FOREIGN PATENT DOCUMENTS

KR 20100000284 U 1/2010

OTHER PUBLICATIONS

Galpada Baseball Cap Insert Hat Shaper . . . [online]; [date first available to the internet on Jul. 26, 2022]; [retrieved from the internet on Jan. 24, 2024]; URL: https://www.amazon.com/GALPADA-Baseball-Cap-Insert-Shaper/dp/ B0B7QSHFFD?th=1&psc=1. (4 pages). (Year: 2022).

*Primary Examiner* — Heather Mangine
(74) *Attorney, Agent, or Firm* — Inventech Patent Services, LLC; Marc A. Scharich

(57) ABSTRACT

A wearable brim shaper for a ball cap includes top and bottom walls having respective rear edges, and left and right sidewalls having respective rear edges. The left sidewall merges with the top and bottom walls such that the rear edges of the left sidewall and the top and bottom walls together form a left U-shaped rear edge. The right sidewall merges with the top and bottom walls such that the rear edges of the right sidewall and the top and bottom walls together form a right U-shaped rear edge. An inner cavity is defined between at least the top and bottom walls and the left and right sidewalls. The wearable brim shaper is installable on a brim of a ball cap such that at least a rear portion of the brim of the ball cap extends through a rear opening of the inner cavity and into the inner cavity.

19 Claims, 16 Drawing Sheets

(56) References Cited

U.S. PATENT DOCUMENTS 5,956,773 A * 9/1999 LaMantia ..... A42C 5/02 2/181
5,991,927 A * 11/1999 Barbaccia ..... A42B 1/002 2/244
D419,281 S * 1/2000 Croft ..... D2/893
6,044,495 A * 4/2000 Ellman ..... A42B 1/0184 2/209.13
6,081,933 A * 7/2000 Partsch, IV ..... A42B 3/227 2/422
6,173,447 B1 * 1/2001 Arnold ..... A42B 1/0184 2/10
6,491,390 B1 * 12/2002 Provost ..... A42B 1/247 2/10
6,584,614 B2 * 7/2003 Hogg ..... A42B 1/0181 2/9
D507,093 S 7/2005 Burmester
D517,287 S 3/2006 Burmester
D526,473 S * 8/2006 Otterson ..... D16/330
7,097,080 B2 * 8/2006 Cox ..... A42B 1/002 223/84
7,103,920 B1 * 9/2006 Otterson ..... G02C 3/02 2/209.13
7,461,764 B2 12/2008 Thompson
D591,934 S * 5/2009 Gore ..... D2/891
7,591,026 B2 * 9/2009 Kronenberger ..... A42B 1/002 2/209.13
8,191,175 B1 * 6/2012 White ..... A42B 1/18 2/175.4
8,231,034 B2 * 7/2012 Styles ..... A42C 1/06 223/12
8,266,722 B2 * 9/2012 Wang ..... A42B 1/0182 2/195.6
8,640,264 B2 * 2/2014 Ramer ..... A42B 1/0182 2/195.1
8,973,166 B1 * 3/2015 Engle ..... A42B 1/0183 2/209.12
9,078,483 B1 * 7/2015 Snyder ..... A42B 1/247
9,179,720 B1 * 11/2015 Bonadio, Jr. ..... A42B 1/004
D832,559 S 11/2018 Burmester
D838,441 S 1/2019 Romo
D862,847 S * 10/2019 Emery ..... D2/893
D904,770 S * 12/2020 Murray ..... D6/315
D917,183 S * 4/2021 Murray ..... D6/315
D928,462 S * 8/2021 Plymale ..... D2/891
D933,337 S 10/2021 Kanzler et al.
11,278,750 B1 * 3/2022 Acomb ..... G10K 11/161
11,535,978 B2 12/2022 Wynn et al.
11,627,775 B1 * 4/2023 Devine ..... A42B 3/227 2/15
11,832,671 B1 * 12/2023 Cardenas, III ..... B65D 85/18
D1,017,970 S * 3/2024 Delerme ..... D2/893
2003/0019890 A1 1/2003 Lawrence
2005/0172380 A1 * 8/2005 Turkington ..... A42B 1/248 2/175.4
2006/0195970 A1 * 9/2006 Kronenberger ..... A42B 1/24 2/209
2007/0283482 A1 * 12/2007 Lawrence ..... A42B 1/0183 2/209.12
2008/0066215 A1 * 3/2008 Thompson ..... A42B 1/0182 2/175.5
2009/0119819 A1 * 5/2009 Thompson ..... A42B 1/0182 2/209.13
2013/0047317 A1 * 2/2013 Hanover ..... F41H 1/04 2/209.12
2013/0125292 A1 * 5/2013 Weaver ..... A42B 1/006 2/209.13
2015/0090746 A1 * 4/2015 Quinones ..... A42B 1/0183 223/12
2015/0113708 A1 * 4/2015 Hill ..... A42B 1/0183 2/244
2016/0316841 A1 * 11/2016 Melnyk ..... A42B 1/002
2017/0006948 A1 * 1/2017 Quinones ..... A42B 1/0183
2017/0049219 A1 * 2/2017 Seals ..... A45F 5/06
2017/0156431 A1 * 6/2017 Hester ..... A42B 1/0184
2017/0245572 A1 * 8/2017 Han ..... A63H 33/086
2017/0347733 A1 * 12/2017 Durand, Jr. ..... A42B 1/0184
2018/0116325 A1 * 5/2018 Woods ..... A42B 1/24
2019/0315282 A1 * 10/2019 Murray ..... B60R 7/10
2019/0390397 A1 * 12/2019 Wynn ..... A42B 1/002
2020/0163395 A1 * 5/2020 Giles ..... A42B 1/002
2020/0237043 A1 * 7/2020 Weller ..... A42B 1/0182
2020/0359726 A1 * 11/2020 Hamilton ..... A45C 11/02
2021/0267296 A1 * 9/2021 Baptista ..... A42B 1/0184
2021/0321690 A1 * 10/2021 Travis ..... A42B 1/0181
2021/0321806 A1 * 10/2021 Giles ..... A47G 25/10
2022/0202123 A1 * 6/2022 Newsham ..... A42B 1/009
2023/0149218 A1 * 5/2023 Franklin ..... A62B 18/02 128/858

* cited by examiner

WEARABLE BRIM SHAPER FOR A BALL CAP

TECHNICAL FIELD

The present disclosure relates generally to headwear and, more particularly, to a wearable brim shaper for a ball cap.

BACKGROUND

This section provides background information related to the present disclosure which is not necessarily prior art.

Over the years, wearing ball caps has become very popular and fashionable not only with the general public, but also with various celebrities such as athletes, music artists, actors, podcasters, social media content creators, and others.

Due to such factors as overall function, comfort, and style, it is often desirable to shape a brim of a ball cap such that the brim curves downwardly. Unfortunately, the shaping of a ball cap brim is often associated with various challenges and limitations. For example, the downward curve of the brim of the ball cap is often manually shaped by bending the brim by hand. However, such manual shaping of the brim of the ball cap often results in the downward curve of the brim being inconsistent or asymmetrical (i.e., lopsided). Moreover, even if the ball cap brim is adequately or desirably shaped by manually bending the brim by hand, it is often difficult to maintain the desired shape of the brim, particularly when the ball cap is stored or transported. Similarly, while certain brands or styles of ball caps are advantageously sold with a desirable downwardly-curved brim that is shaped at the store or manufacturing facility with specialized equipment, the desired shape of the brim is often still difficult to maintain, particularly when the ball cap is stored or transported as mentioned above.

In an attempt to aid or facilitate the shaping of ball cap brims, some brim shapers for ball caps currently exist, however, such existing brim shapers are often associated with various challenges and limitations. For example, such existing brim shapers for ball caps are often bulky, heavy, unstylish, unwearable (i.e., unable to be worn in a feasible or comfortable manner), or are unable to adequately shape and maintain a desired shape of a ball cap brim.

SUMMARY

This section provides a general summary of the present disclosure and is not a comprehensive disclosure of its full scope or all of its features.

The present disclosure aims to overcome the aforementioned challenges and limitations associated with both shaping and maintaining a desired shape of a ball cap brim. Moreover, the present disclosure aims to overcome the aforementioned challenges and limitations associated with the use of existing brim shapers for ball caps.

According to one or more embodiments of the present disclosure, a wearable brim shaper for a ball cap includes a top wall having a top surface that curves at least downwardly, an opposing bottom surface that curves at least downwardly, and a rear edge defined between at least the top and bottom surfaces of the top wall. The rear edge of the top wall has a central curved segment that curves at least downwardly and rearwardly. The rear edge of the top wall further has a left curved segment that curves downwardly but not rearwardly. The left curved segment merges with the central curved segment at a first intersection. The rear edge of the top wall further has a right curved segment that curves downwardly but not rearwardly. The right curved segment merges with the central curved segment at a second intersection. Additionally, the wearable brim shaper further includes a bottom wall having a top surface that curves at least downwardly, an opposing bottom surface that curves at least downwardly, and a rear edge defined between at least the top and bottom surfaces of the bottom wall. The rear edge of the bottom wall has a central curved segment that curves at least downwardly and rearwardly. The rear edge of the bottom wall further has a left curved segment that curves downwardly but not rearwardly. The left curved segment of the rear edge of the bottom wall merges with the central curved segment of the rear edge of the bottom wall at a third intersection. The rear edge of the bottom wall further has a right curved segment that curves downwardly but not rearwardly. The right curved segment of the rear edge of the bottom wall merges with the central curved segment of the rear edge of the bottom wall at a fourth intersection. Additionally, the wearable brim shaper further includes a left sidewall having an outer surface, an opposing inner surface, and a rear edge defined between at least the outer and inner surfaces of the left sidewall. The left sidewall merges with the top wall and the bottom wall such that the rear edge of the left sidewall, the left curved segment of the rear edge of the top wall, and the left curved segment of the rear edge of the bottom wall together form a left U-shaped rear edge of the wearable brim shaper that terminates at the respective first and third intersections. Additionally, the wearable brim shaper further includes a right sidewall having an outer surface, an opposing inner surface, and a rear edge defined between at least the outer and inner surfaces of the right sidewall. The right sidewall merges with the top wall and the bottom wall such that the rear edge of the right sidewall, the right curved segment of the rear edge of the top wall, and the right curved segment of the rear edge of the bottom wall together form a right U-shaped rear edge of the wearable brim shaper that terminates at the respective second and fourth intersections. Additionally, the wearable brim shaper further includes an inner cavity defined between at least the bottom surface of the top wall, the top surface of the bottom wall, the inner surface of the left sidewall, and the inner surface of the right sidewall. The inner cavity has a rear opening defined between at least the rear edges of the top wall, the bottom wall, the left sidewall, and the right sidewall. The rear opening is shaped and sized to allow a brim of a ball cap to extend therethrough. The wearable brim shaper is installable on the brim of the ball cap such that, when the wearable brim shaper is installed on the brim of the ball cap, at least a rear portion of the brim of the ball cap extends through the rear opening of the inner cavity and into the inner cavity.

According to one or more embodiments of the present disclosure, a wearable brim shaper for a ball cap includes a curved top wall having a top surface that curves at least downwardly, an opposing bottom surface that curves at least downwardly, and a rear edge having a rear edge surface defined between at least the top and bottom surfaces of the curved top wall. The rear edge of the curved top wall further has a central curved segment that curves at least downwardly and rearwardly. The rear edge of the curved top wall further has a left curved segment that curves downwardly. The left curved segment merges with the central curved segment at a first intersection. The rear edge of the curved top wall further has a right curved segment that curves downwardly. The right curved segment merges with the central curved segment at a second intersection. Additionally, the wearable brim shaper further includes a curved bottom wall having a top surface that curves at least downwardly, an opposing bottom surface that curves at least downwardly, and a rear edge having a rear edge surface defined between at least the top and bottom surfaces of the curved bottom wall. The rear edge of the curved bottom wall further has a central curved segment that curves at least downwardly and rearwardly. The rear edge of the curved bottom wall further has a left curved segment that curves downwardly. The left curved segment of the rear edge of the curved bottom wall merges with the central curved segment of the rear edge of the curved bottom wall at a third intersection. The rear edge of the curved bottom wall further has a right curved segment that curves downwardly. The right curved segment of the rear edge of the curved bottom wall merges with the central curved segment of the rear edge of the curved bottom wall at a fourth intersection. Additionally, the wearable brim shaper further includes a curved left sidewall having an outer surface that is curved, an opposing inner surface that is curved, and a rear edge having a rear edge surface defined between at least the outer and inner surfaces of the curved left sidewall. The curved left sidewall merges with the curved top wall and the curved bottom wall such that the rear edge of the curved left sidewall, the left curved segment of the rear edge of the curved top wall, and the left curved segment of the rear edge of the curved bottom wall are coplanar with respect to each other. Additionally, the wearable brim shaper further includes a curved right sidewall having an outer surface that is curved, an opposing inner surface that is curved, and a rear edge having a rear edge surface defined between at least the outer and inner surfaces of the curved right sidewall. The curved right sidewall merges with the curved top wall and the curved bottom wall such that the rear edge of the curved right sidewall, the right curved segment of the rear edge of the curved top wall, and the right curved segment of the rear edge of the curved bottom wall are coplanar with respect to each other. Additionally, the wearable brim shaper further includes an inner cavity defined between at least the bottom surface of the curved top wall, the top surface of the curved bottom wall, the inner surface of the curved left sidewall, and the inner surface of the curved right sidewall. The inner cavity has a rear opening defined between at least the rear edges of the curved top wall, the curved bottom wall, the curved left sidewall, and the curved right sidewall. The rear opening is shaped and sized to allow a brim of a ball cap to extend therethrough. The wearable brim shaper is installable on the brim of the ball cap such that, when the wearable brim shaper is installed on the brim of the ball cap, at least a rear portion of the brim of the ball cap extends through the rear opening of the inner cavity and into the inner cavity.

BRIEF DESCRIPTION OF THE DRAWINGS

The present disclosure will become more fully understood from the detailed description and the accompanying drawings, wherein.

DETAILED DESCRIPTION

Figure 1:
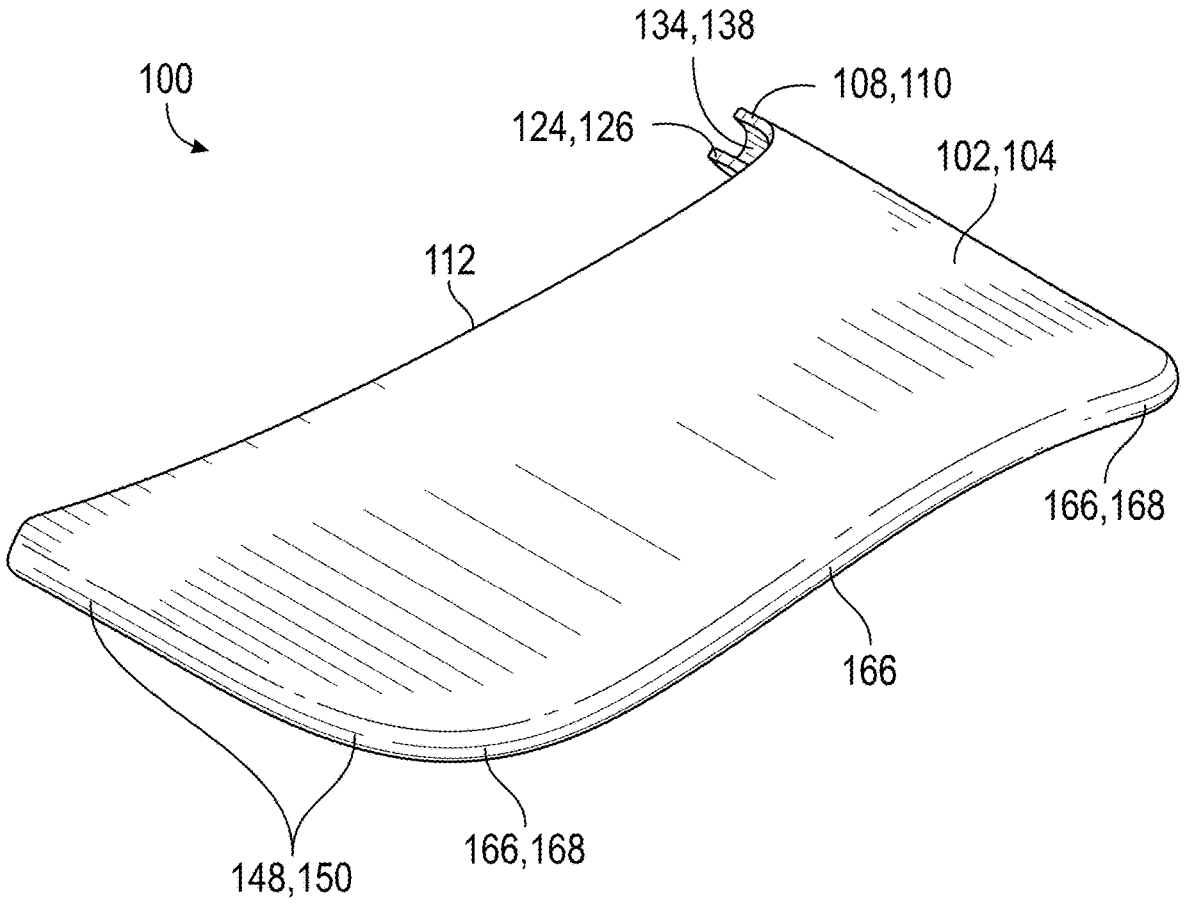
FIG. 1 is a top, right, front perspective view of a wearable brim shaper for a ball cap, according to one embodiment of the present disclosure.
Figure 2:
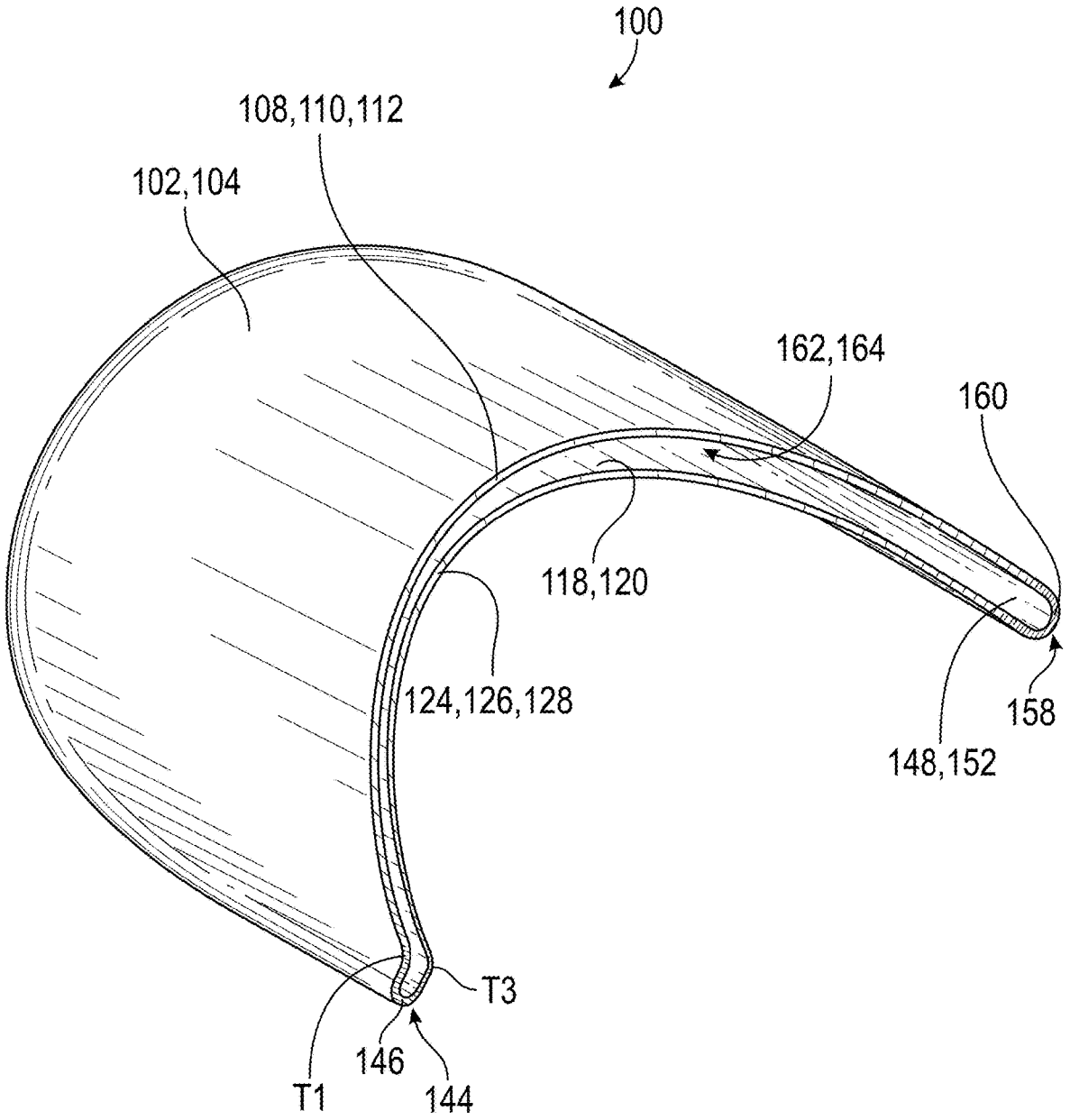
FIG. 2 is a top, left, rear perspective view of the wearable brim shaper shown in FIG. 1.
Figure 3:
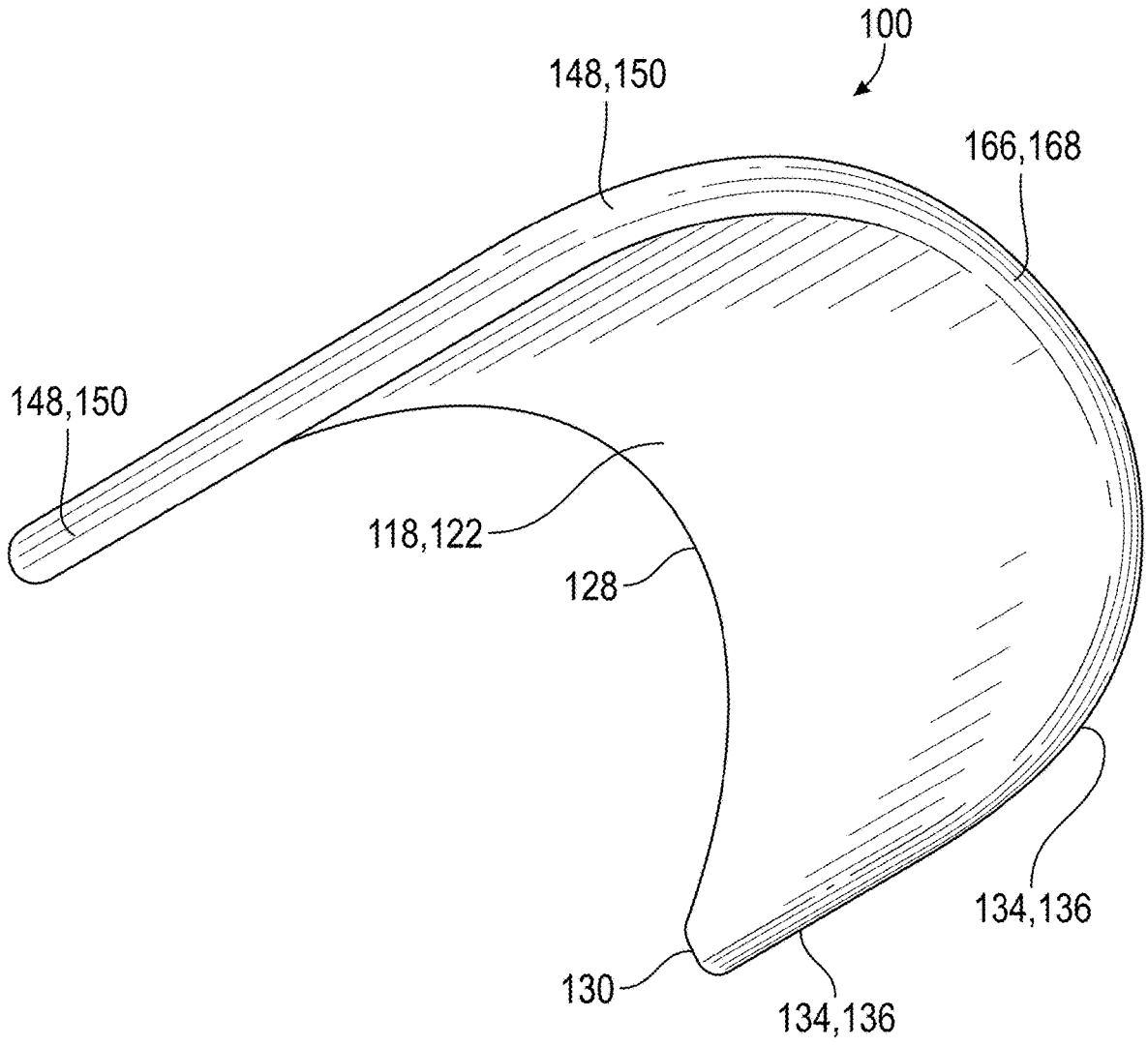
FIG. 3 is a bottom, right, front perspective view of the wearable brim shaper shown in FIGS. 1 and 2.
Figure 4:
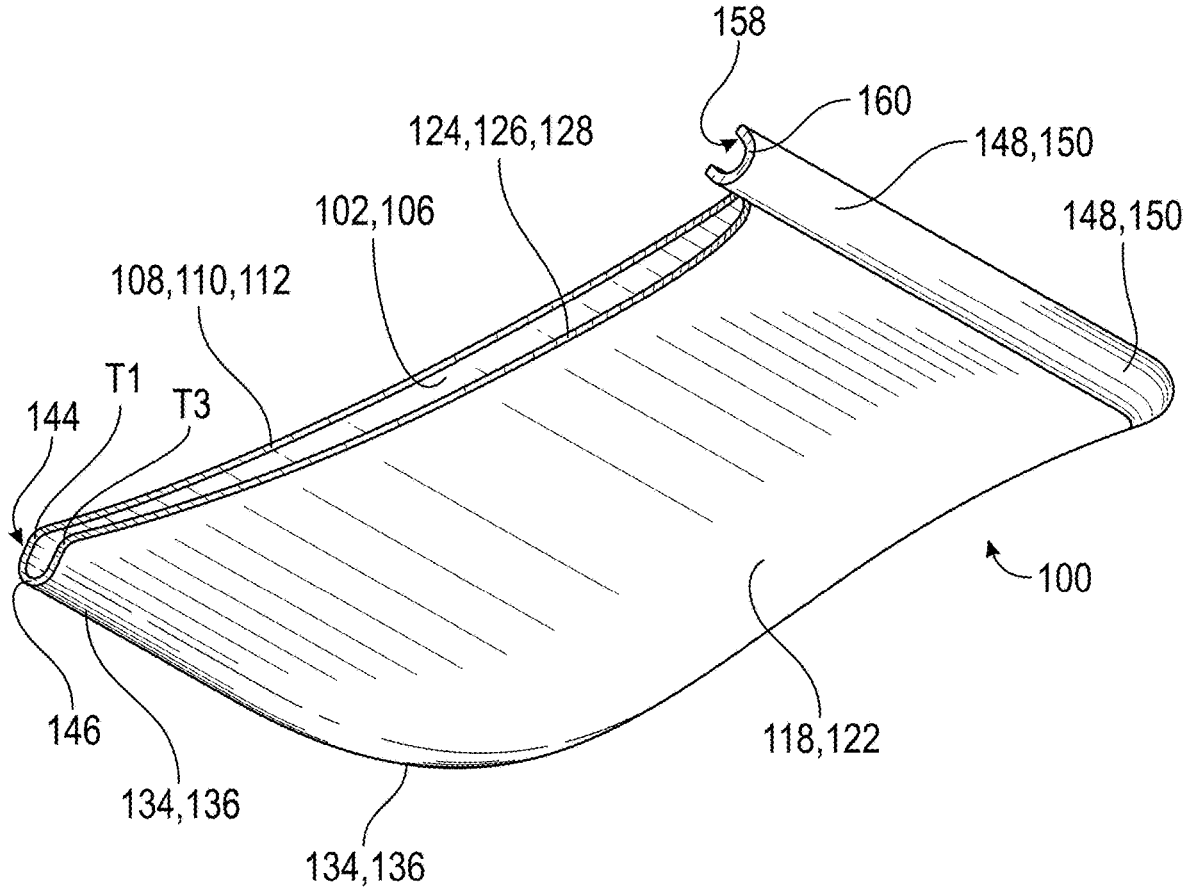
FIG. 4 is a bottom, right, rear perspective view of the wearable brim shaper shown in FIGS. 1-3.

As required, one or more detailed embodiments of the present disclosure are disclosed herein, however, it is to be understood that the disclosed embodiments are merely illustrative of the present disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure. Furthermore, the use of a singular term, such as, "a" is not to be interpreted as limiting the number of components or details of particular components. Moreover, the use of the word "or" in reference to a list of two or more components or details covers all of the following interpretations of the word: any of the components or details in the list, all of the components or details in the list, and any combination of the components or details in the list. Additionally, various terms and/or phrases describing or indicating a position or directional reference such as, but not limited to, "top", "bottom", "front", "rear", "forward", "rearward", "end", "outer", "inner", "left", "right", "vertical", "horizontal", "upper", "upwardly, "lower", "downwardly", etc. may relate to one or more particular components as seen generally from a user's vantage point during use or operation, and such terms and/or phrases are not to be interpreted as limiting, but merely as a representative basis for describing the present disclosure to one skilled in the art. Moreover, as one skilled in the art will understand, various features illustrated and described with reference to any one of the figures may be combined with features illustrated in one or more other figures to produce embodiments that are not explicitly illustrated or described herein. The combinations of features illustrated provide representative embodiments for typical applications. Various combinations and modifications of the features consistent with the teachings of this disclosure, however, could be desired for particular applications or implementations.

Referring generally to the figures, a wearable brim shaper 100 for a ball cap according to embodiments (FIGS. 1-9 and 15-17; FIGS. 10-14, 18 and 19) of the present disclosure is collectively shown and described herein. As will be further discussed herein, the wearable brim shaper 100 may be advantageously installed on various ball caps, such as an illustrative ball cap 200 that has a brim 202, as shown in FIGS. 15-19.

Referring to FIGS. 1-19, the wearable brim shaper 100 includes a top wall 102 that is curved. The top wall 102 has a top surface 104 that curves at least downwardly, an opposing bottom surface 106 that curves at least downwardly, and a rear edge 108 having a rear edge surface 110 defined between at least the top and bottom surfaces 104, 106 of the top wall 102. The rear edge 108 of the top wall 102 further has a central curved segment 112 that curves at least downwardly and rearwardly. In this regard, it is to be understood that such phrases as "curves/curving at least downwardly" or "curves/curving at least downwardly and rearwardly" generally describes at least downwardly with respect to at least a side-to-side (i.e., left-to-right) direction D1 (FIGS. 5 and 11) of the wearable brim shaper 100, and "at least rearwardly" generally describes at least rearwardly with respect to at least a front-to-rear direction D2 (FIGS. 5 and 11) of the wearable brim shaper 100. The rear edge 108 of the top wall 102 further has a left curved segment 114 that curves downwardly but not rearwardly. The left curved segment 114 merges with the central curved segment 112 at a first intersection T1. The rear edge 108 of the top wall 102 further has a right curved segment 116 that curves downwardly but not rearwardly. The right curved segment 116 merges with the central curved segment 112 at a second intersection T2.

Additionally, the wearable brim shaper 100 further includes a bottom wall 118 that is curved. The bottom wall 118 has a top surface 120 that curves at least downwardly, an opposing bottom surface 122 that curves at least downwardly, and a rear edge 124 having a rear edge surface 126 defined between at least the top and bottom surfaces 120, 122 of the bottom wall 118. The rear edge 124 of the bottom wall 118 further has a central curved segment 128 that curves at least downwardly and rearwardly. The rear edge 124 of the bottom wall 118 further has a left curved segment 130 that curves downwardly but not rearwardly. The left curved segment 130 of the rear edge 124 of the bottom wall 118 merges with the central curved segment 128 of the rear edge 124 of the bottom wall 118 at a third intersection T3. The rear edge 124 of the bottom wall 118 further has a right curved segment 132 that curves downwardly but not rearwardly. The right curved segment 132 of the rear edge 124 of the bottom wall 118 merges with the central curved segment 128 of the rear edge 124 of the bottom wall 118 at a fourth intersection T4.

Additionally, the wearable brim shaper 100 further includes a left sidewall 134 that is curved. The left sidewall 134 has an outer surface 136 that is curved, an opposing inner surface 138 that is curved, and a rear edge 140 having a rear edge surface 142 defined between at least the outer and inner surfaces 136, 138 of the left sidewall 134. The left sidewall 134 merges with the top wall 102 and the bottom wall 118 such that the rear edge 140 of the left sidewall 134, the left curved segment 114 of the rear edge 108 of the top wall 102, and the left curved segment 130 of the rear edge 124 of the bottom wall 118 are coplanar with respect to each other in a vertical plane P1 that is perpendicular to a center axis C1 of the wearable brim shaper 100 that extends in the front-to-rear direction D2 of the wearable brim shaper 100 (i.e., as shown in at least the top plan views of the wearable brim shaper 100 in FIGS. 5 and 11). Moreover, the left sidewall 134 merges with the top wall 102 and the bottom wall 118 such that the rear edge 140 of the left sidewall 134, the left curved segment 114 of the rear edge 108 of the top wall 102, and the left curved segment 130 of the rear edge 124 of the bottom wall 118 together form a left U-shaped rear edge 144 of the wearable brim shaper 100 that terminates at the respective first and third intersections T1, T3. The left U-shaped rear edge 144 of the wearable brim shaper 100 advantageously has a flat or substantially flat U-shaped rear edge surface 146, as will be further discussed herein.

Additionally, the wearable brim shaper 100 further includes a right sidewall 148 that is curved. The right sidewall 148 has an outer surface 150 that is curved, an opposing inner surface 152 that is curved, and a rear edge 154 having a rear edge surface 156 defined between at least the outer and inner surfaces 150, 152 of the right sidewall 148. The right sidewall 148 merges with the top wall 102 and the bottom wall 118 such that the rear edge 154 of the right sidewall 148, the right curved segment 116 of the rear edge 108 of the top wall 102, and the right curved segment 132 of the rear edge 124 of the bottom wall 118 are coplanar with respect to each other in the vertical plane P1 that is perpendicular to the center axis C1 of the wearable brim shaper 100 that extends in the front-to-rear direction D2 of the wearable brim shaper 100 (i.e., as shown in at least the top plan views of the wearable brim shaper 100 in FIGS. 5 and 11). Moreover, The right sidewall 148 merges with the top wall 102 and the bottom wall 118 such that the rear edge 154 of the right sidewall 148, the right curved segment 116 of the rear edge 108 of the top wall 102, and the right curved segment 132 of the rear edge 124 of the bottom wall 118 together form a right U-shaped rear edge 158 of the wearable brim shaper 100 that terminates at the respective second and fourth intersections T2, T4. The right U-shaped rear edge 158 of the wearable brim shaper 100 advantageously has a flat or substantially flat U-shaped rear edge surface 160, as will be further discussed herein.

Figure 5:
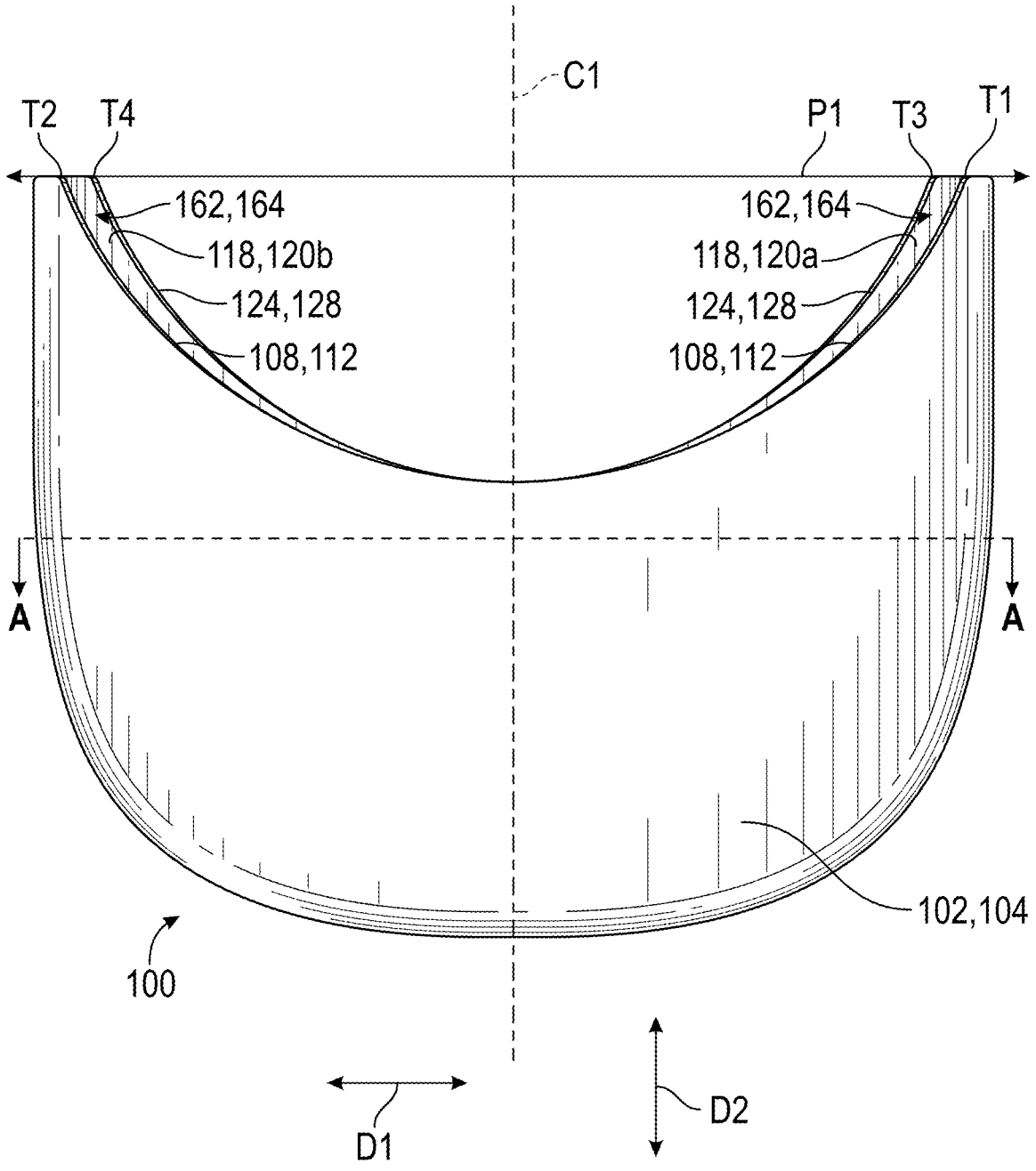
FIG. 5 is a top plan view of the wearable brim shaper shown in FIGS. 1-4.
Figure 6:
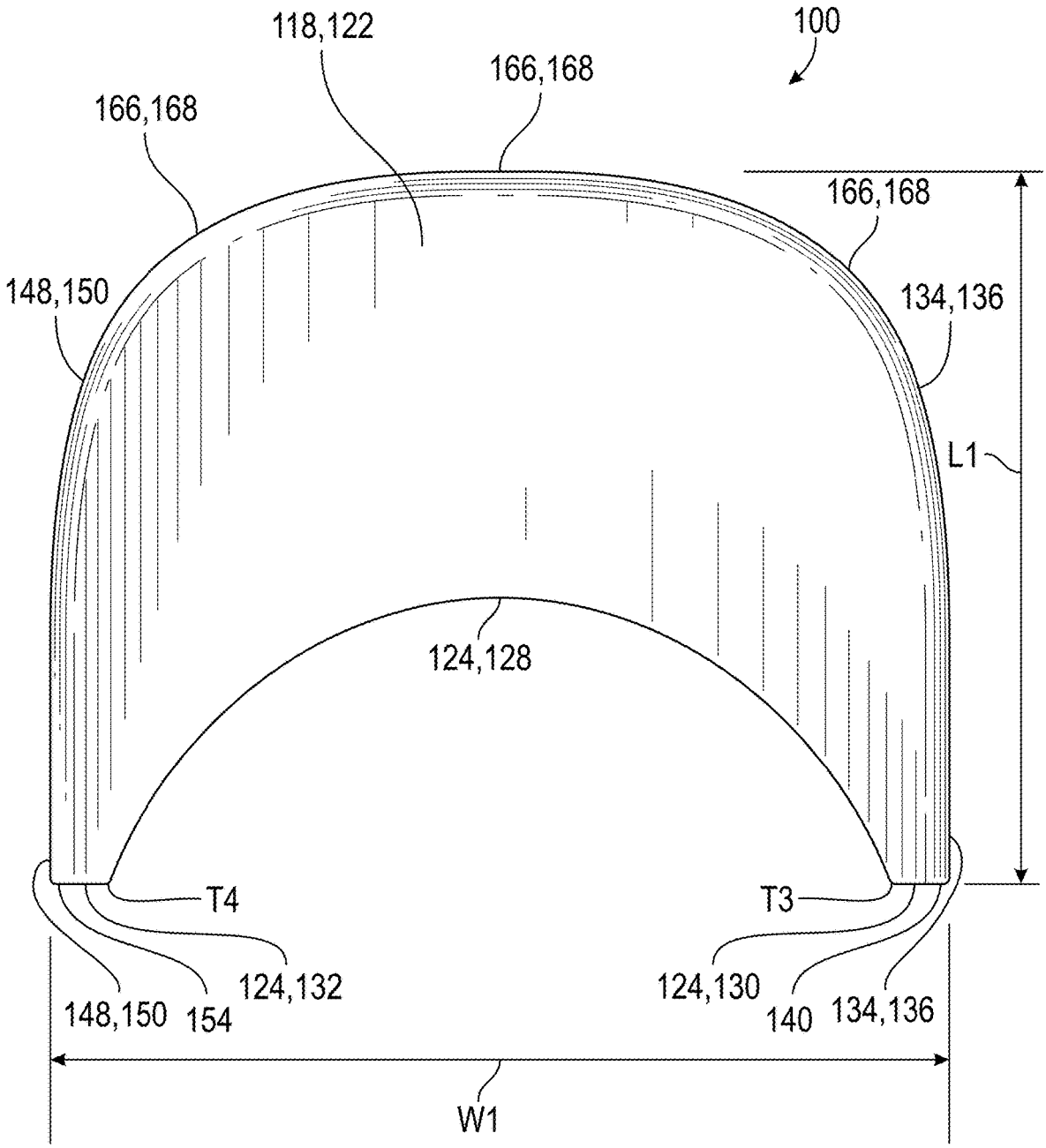
FIG. 6 is a bottom plan view of the wearable brim shaper shown in FIGS. 1-5.
Figure 7:
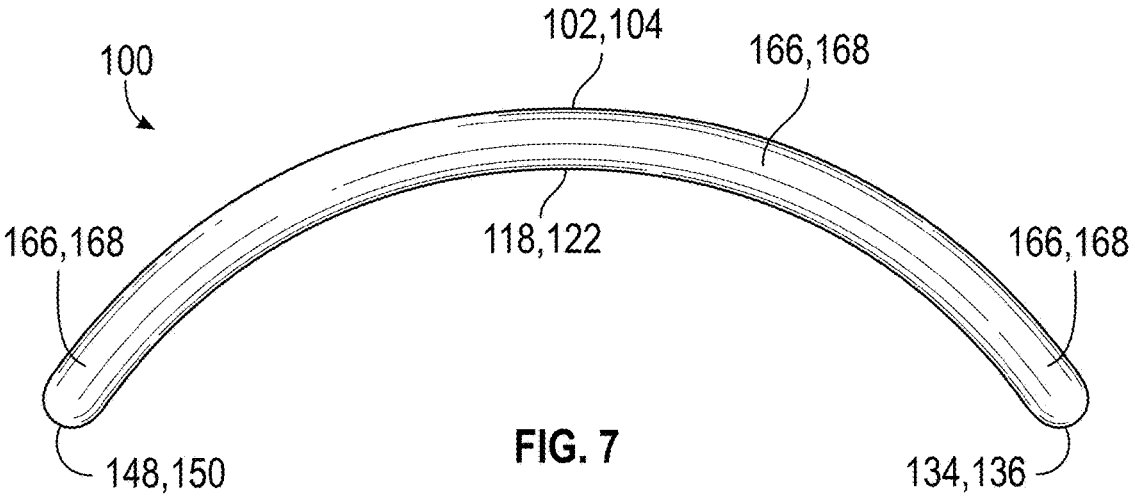
FIG. 7 is a front elevational view of the wearable brim shaper shown in FIGS. 1-6.
Figure 8:
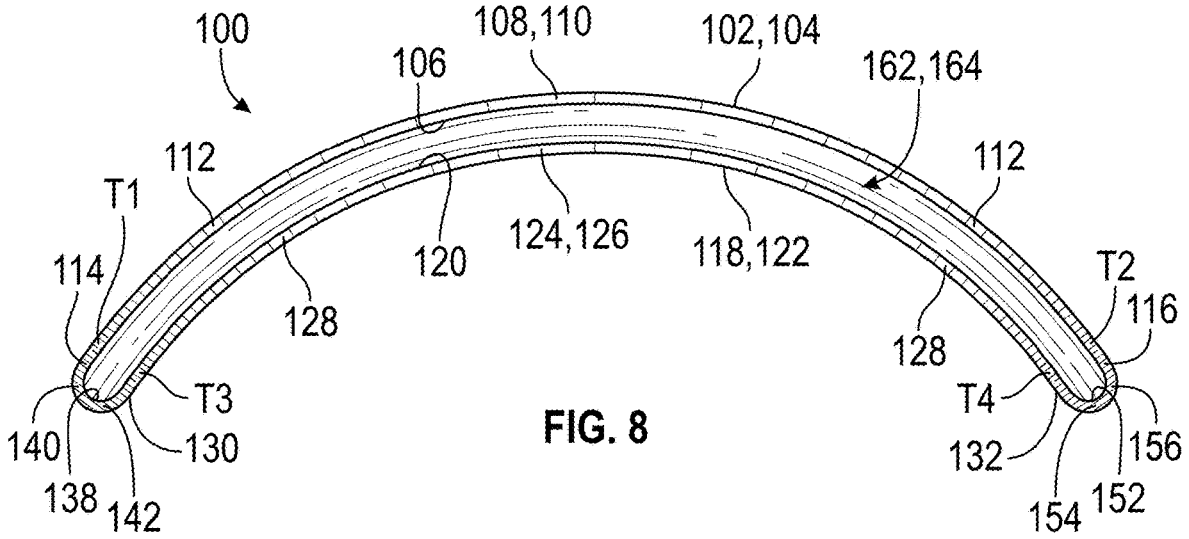
FIG. 8 is a rear elevational view of the wearable brim shaper shown in FIGS. 1-7.
Figure 11:
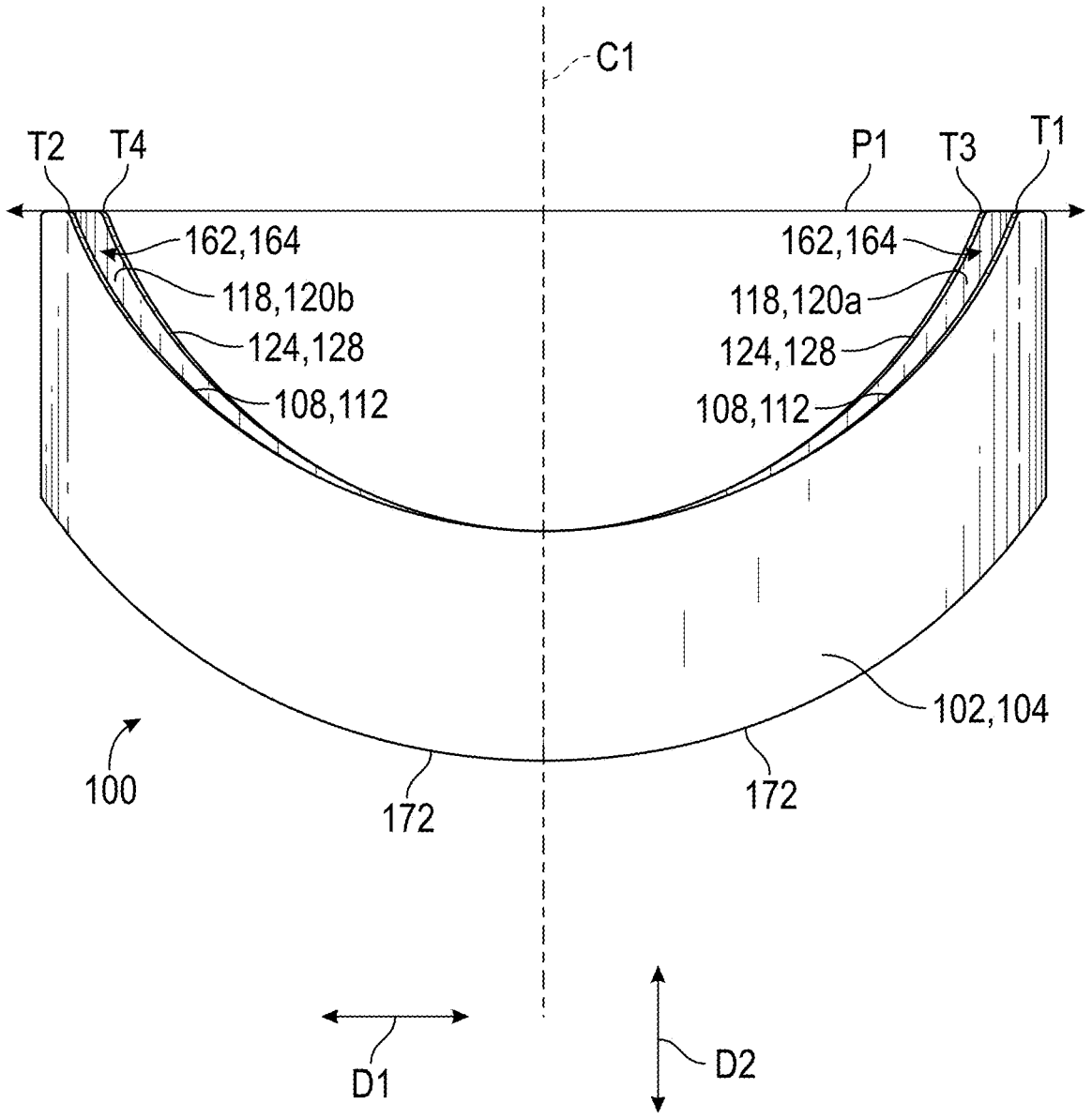
FIG. 11 is a top plan view of the wearable brim shaper shown in FIG. 10.
Figure 12:
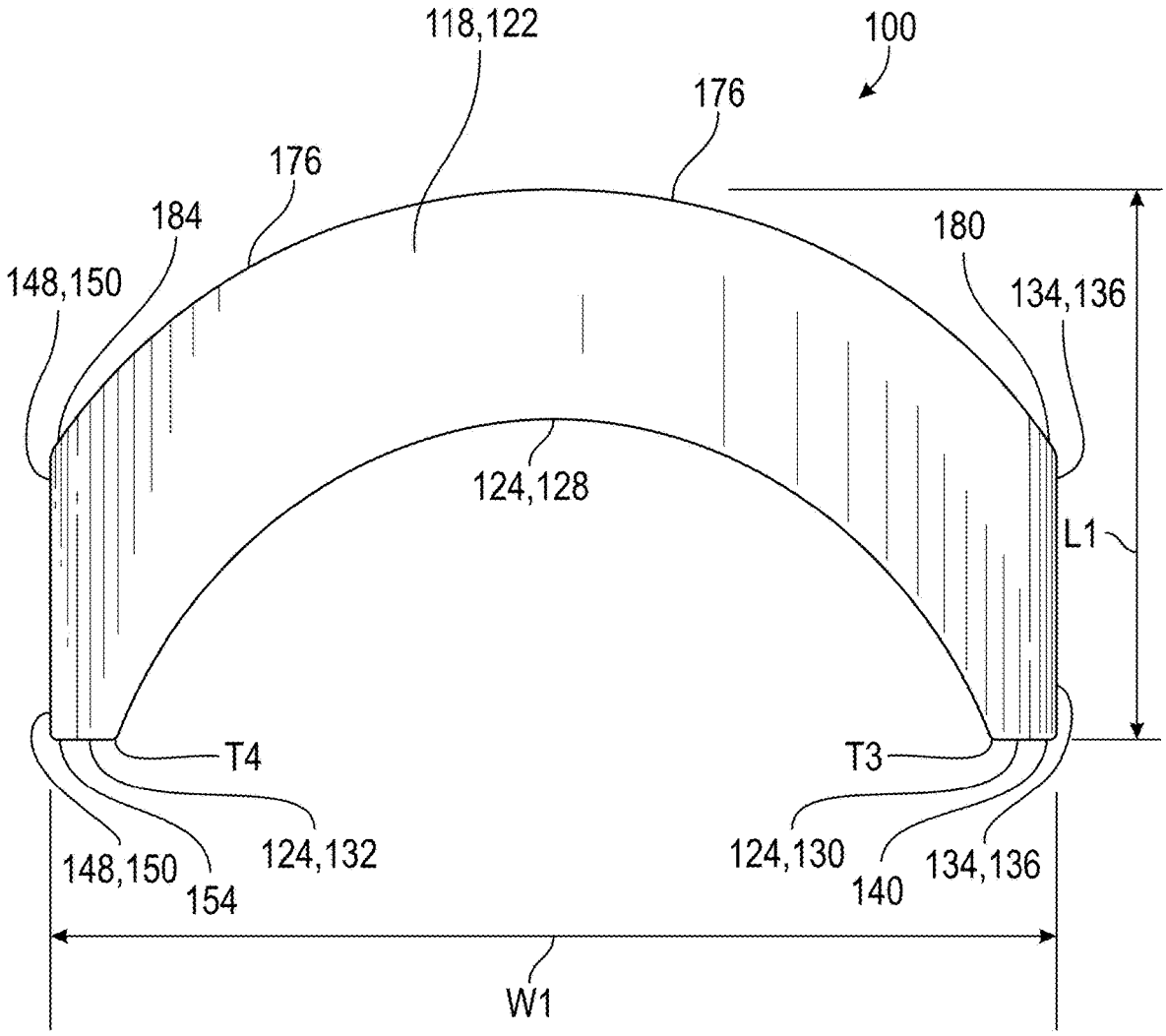
FIG. 12 is a bottom plan view of the wearable brim shaper shown in FIGS. 10 and 11.
Figure 13:
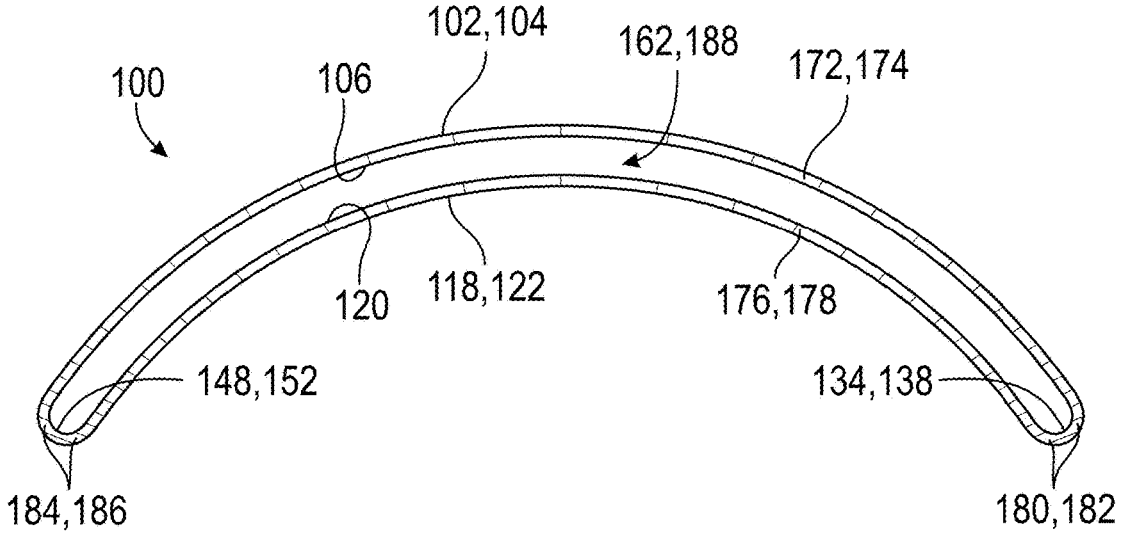
FIG. 13 is a front elevational view of the wearable brim shaper shown in FIGS. 10-12.
Figure 14:
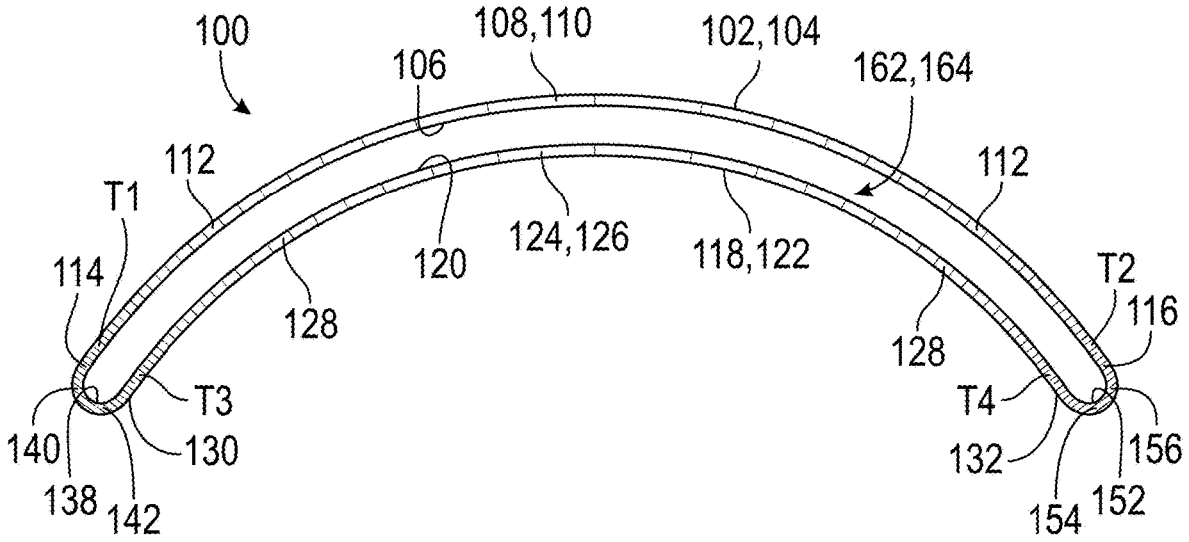
FIG. 14 is a rear elevational view of the wearable brim shaper shown in FIGS. 10-13.
Figure 15:
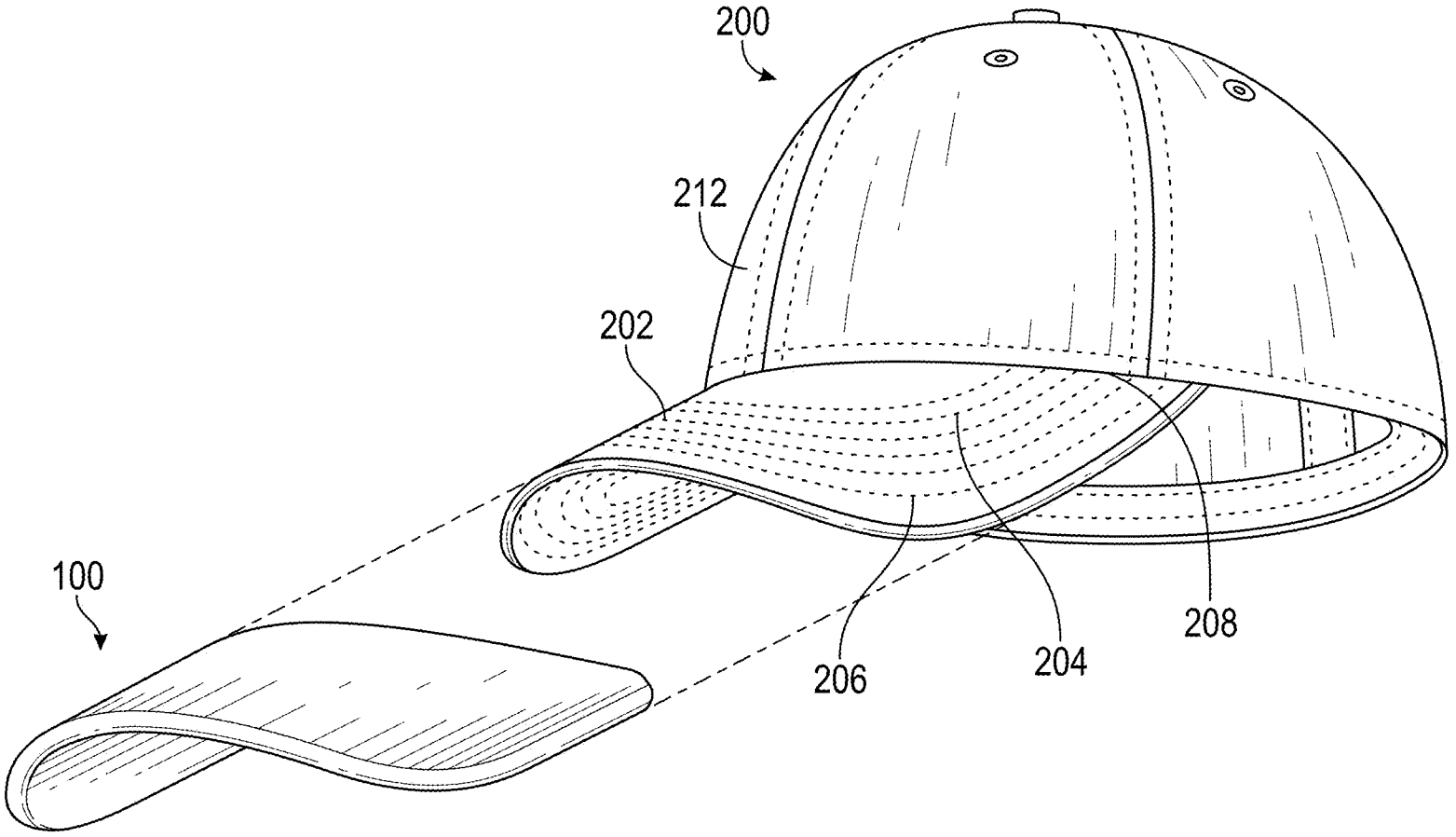
FIG. 15 is a left, front perspective view of an illustrative ball cap and the wearable brim shaper shown in FIGS. 1-9, illustrating the wearable brim shaper removed from a brim of the ball cap.

As shown particularly in FIGS. 5 and 11, in at least the top plan view of the wearable brim shaper 100, the left U-shaped rear edge 144, the right U-shaped rear edge 158, the first intersection T1, the second intersection T2, the third intersection T3, and the fourth intersection T4 are coplanar with respect to each other in the vertical plane P1 that is perpendicular to the center axis C1 of the wearable brim shaper 100.

Figure 9:
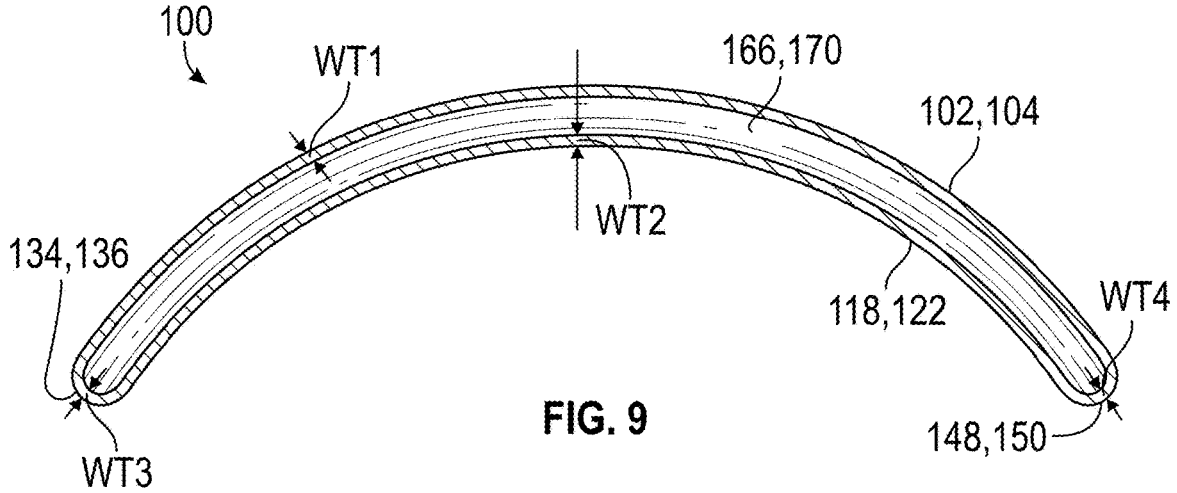
FIG. 9 is a rear elevational cross-sectional view of the wearable brim shaper taken along line A-A shown in FIG. 5.
Figure 10:
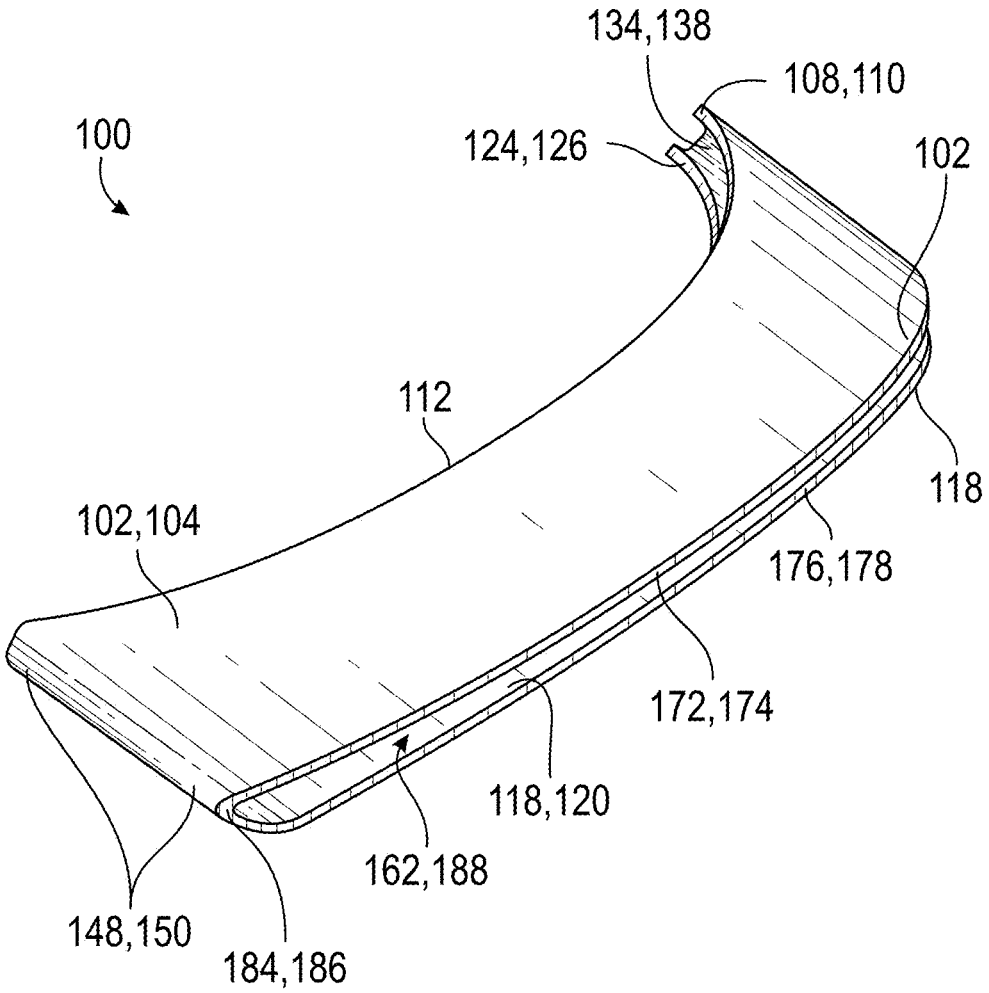
FIG. 10 is a top, right, front perspective view of a wearable brim shaper for a ball cap, according to another embodiment of the present disclosure.

As shown in FIG. 9, the top wall 102 further has a cross-sectional wall thickness WT1 defined between the top and bottom surfaces 104, 106 of the top wall 102. The bottom wall 118 further has a cross-sectional wall thickness WT2 defined between the top and bottom surfaces 120, 122 of the bottom wall 118. The left sidewall 134 further has a cross-sectional wall thickness WT3 defined between the outer and inner surfaces 136, 138 of the left sidewall 134. The right sidewall 148 further has a cross-sectional wall thickness WT4 defined between the outer and inner surfaces 150, 152 of the right sidewall 148. As further shown in FIG. 9, each of the respective cross-sectional wall thicknesses WT1, WT2, WT3, WT4 of the top wall 102, the bottom wall 118, the left sidewall 134, and the right sidewall 148 is equal or substantially equal with respect to each other. In this regard, each of the respective cross-sectional wall thicknesses WT1, WT2, WT3, WT4 of the top wall 102, the bottom wall 118, the left sidewall 134, and the right sidewall 148 is preferably 2 millimeters or less, which may include 1 millimeter, or any other wall thickness value that is 2 millimeters or less. In this regard, the overall consistency and relative thinness of each wall thickness advantageously reduces weight of the wearable brim shaper 100, while also making installation of the wearable brim shaper 100 more convenient, as will be further described herein. Alternatively, each of the respective cross-sectional wall thicknesses WT1, WT2, WT3, WT4 of the top wall 102, the bottom wall 118, the left sidewall 134, and the right sidewall 148 may be more than 2 millimeters, as may be understood by one skilled in the art.

Additionally, the wearable brim shaper 100 further includes an inner cavity 162 defined between at least the bottom surface 106 of the top wall 102, the top surface 120 of the bottom wall 118, the inner surface 138 of the left sidewall 134, and the inner surface 152 of the right sidewall 148. The inner cavity 162 has a rear opening 164 defined between at least the rear edge 108 of the top wall 102, the rear edge 124 of the bottom wall 118, the rear edge 140 of the left sidewall 134, and the rear edge 154 of the right sidewall 148. As will be further discussed herein, the rear opening 164 of the inner cavity 162 is shaped and sized to allow the brim 202 of the ball cap 200 to extend therethrough.

As shown particularly in FIGS. 5 and 11, in at least the top plan view of the wearable brim shaper 100, the central curved segment 112 of the rear edge 108 of the top wall 102 and the central curved segment 128 of the rear edge 124 of the bottom wall 118 advantageously diverge from each other. As a result, as further shown particularly in FIGS. 5 and 11, in at least the top plan view of the wearable brim shaper 100, the top wall 102 overlaps the bottom wall 118 such that portions 120*a*, 120*b* of the top surface 120 of the bottom wall 118 that are disposed inside of the inner cavity 162 are visible. Moreover, as shown particularly in FIGS. 6 and 12, in at least a bottom plan view of the wearable brim shaper 100, the bottom wall 118 overlaps the top wall 102 such that the entire bottom surface 106 of the top wall 102 is hidden.

As shown particularly in FIGS. 1-9 and 15-17, the wearable brim shaper 100 may further include a front sidewall 166 that is curved. The front sidewall 166 has an outer surface 168 that is curved and an opposing inner surface 170 that is curved. The front sidewall 166 merges with the top wall 102, the bottom wall 118, the left sidewall 134, and the right sidewall 148. In this regard, in such an embodiment where the wearable brim shaper 100 includes the front sidewall 166, the inner cavity 162 is further defined between at least the bottom surface 106 of the top wall 102, the top surface 120 of the bottom wall 118, the inner surface 138 of the left sidewall 134, the inner surface 152 of the right sidewall 148, and the inner surface 170 of the front sidewall 166.

Alternatively, as shown particularly in FIGS. 10-14, 18 and 19, the top wall 102 of the wearable brim shaper 100 may further have a front edge 172 having a front edge surface 174 defined between at least the top and bottom surfaces 104, 106 of the top wall 102. The front edge 172 of the top wall 102 curves at least downwardly and rearwardly. Moreover, the bottom wall 118 may further have a front edge 176 having a front edge surface 178 defined between at least the top and bottom surfaces 120, 122 of the bottom wall 118. The front edge 176 of the bottom wall 118 curves at least downwardly and rearwardly. In this regard, in such an embodiment where the top and bottom walls 102, 118 have the respective front edges 172, 176, the left sidewall 134 further has a front edge 180 having a front edge surface 182 defined between at least the outer and inner surfaces 136, 138 of the left sidewall 134, and the right sidewall 148 further has a front edge 184 having a front edge surface 186 defined between at least the outer and inner surfaces 150, 152 of the right sidewall 148. Moreover, in such an embodiment where the top and bottom walls 102, 118 have the respective front edges 172, 176 and the left and right sidewalls 134, 148 have respective front edges 180, 184, the inner cavity 162 further has a front opening 188 defined between at least the front edge 172 of the top wall 102, the front edge 176 of the bottom wall 118, the front edge 180 of the left sidewall 134, and the front edge 184 of the right sidewall 148. As will be further discussed herein, the front opening 188 of the inner cavity 162 is shaped and sized to allow the brim 202 of the ball cap 200 to extend therethrough.

The wearable brim shaper 100 is advantageously rigid. As used herein, the term "rigid", or any derivative thereof, is a broad term used in its ordinary sense and refers to the flexural rigidity of a material that avoids substantial deformation after a force has been applied to it. In this regard, the wearable brim shaper 100 as a whole maintains or substantially maintains its rigidity and overall shape when the wearable brim shaper 100 is installed on the brim 202 of the ball cap 200. Likewise, the wearable brim shaper 100 as a whole maintains or substantially maintains its rigidity and overall shape when the wearable brim shaper 100 is not installed on the brim 202 of the ball cap 200. As such, the wearable brim shaper 100 is preferably made of a rigid lightweight material. As non-limiting examples, the rigid lightweight material may be a non-reinforced plastic (e.g., polycarbonate, acrylonitrile butadiene styrene, acrylic, PEEK, etc.), a reinforced plastic (e.g., glass-filled nylon, glass-filled polycarbonate, etc.), a carbon fiber composite, or a metal alloy (e.g., aluminum alloy). The wearable brim shaper 100 may be made of other suitable, rigid lightweight materials as may be understood by one skilled in the art. Moreover, as non-limiting examples, the wearable brim shaper 100 may be made by way of an injection molding process, a resin transfer molding (RTM) process, a metal casting process, a machining process, a 3D printing process, or other suitable manufacturing process such that the wearable brim shaper 100 is monolithically formed as one piece, as may be understood by one skilled in the art.

The wearable brim shaper 100 may advantageously include various decorative decals (not shown) adhered on, for example, the top surface 104 of the top wall 102. In addition, the wearable brim shaper 100 may advantageously include various decorative elements (not shown) molded thereon as part of the wearable brim shaper 100, such as decorative elements that protrude from, or are embossed in, the top surface 104 of the top wall 102. As non-limiting examples, such decorative decals or elements (not shown) may illustrate or exhibit various logos of sports teams, music artists, product or entertainment brands, etc., as may be understood by one skilled in the art.

It is to be understood that the wearable brim shaper 100, as shown in FIGS. 1-9 and 15-17, and the wearable brim shaper 100, as shown in FIGS. 10-14, 18, and 19, are substantially the same (e.g., including having a same overall width W1 (FIGS. 6 and 12) in the side-to-side direction D1 of the wearable brim shaper 100, and including the same various other features and components as previously described herein), except for the following: as described herein, the wearable brim shaper 100, as shown in FIGS. 1-9 and 15-17, has an overall length L1 (FIG. 6) in the front-to-rear direction D2 of the wearable brim shaper 100 that is approximately twice as long as the overall length L1 (FIG. 12) of the wearable brim shaper 100 as shown in FIGS. 10-14, 18, and 19. Moreover, the wearable brim shaper 100, as shown in FIGS. 1-9 and 15-17, has the inner cavity 162 and the front sidewall 166 (i.e., closed configuration) as previously described herein, whereas the wearable brim shaper 100 as shown in FIGS. 10-14, 18, and 19 has the inner cavity 162 with the front opening 188 (i.e., open configuration) as previously described herein.

Referring to FIGS. 15-19, the wearable brim shaper 100 is installable on the brim 202 of the ball cap 200. The ball cap 200 may be one of various brands such as, but not limited to, New Era®. As a non-limiting example, the ball cap 200 may be a ballcap that is sold with a pre-existing, desirable downwardly-curved brim 202 that is shaped at a store or a manufacturing facility (i.e., with specialized equipment). In this regard, the ball cap 200 may be such a ball cap as a New Era® 9TWENTY®, a New Era® 39THIRTY®, a New Era® 9FORTY®, or others. In such a case where the ball cap 200 has a pre-existing, desirable downwardly-curved brim 202 that is pre-shaped at a store or a manufacturing facility, the wearable brim shaper 100 may be installed on the brim 202 of the ball cap 200 so as to advantageously maintain the desirable downwardly-curved shape of the brim 202, and also to keep the brim 202 of the ball cap 200 from possibly being soiled during use (i.e., the wearable brim shaper 100 advantageously also functioning as a brim cover). In other cases, the brim 202 of the ball cap 200 may be manually shaped by a user to approximate the desirable downwardly-curved shape of the brim 202 before installing the wearable brim shaper 100 on the brim 202 of the ball cap 200. In this regard, once the wearable brim shaper 100 is installed on the brim 202 of the ball cap 200, the wearable brim shaper 100 is able to better shape and achieve the desirable downwardly-curved shape of the brim 202, while also eventually advantageously maintaining the desirable downwardly-curved shape of the brim 202 of the ball cap 200 once achieved.

As shown in FIGS. 16-19, when the wearable brim shaper 100 is installed on the brim 202 of the ball cap 200, at least a rear portion 204 of the brim 202 of the ball cap 200 extends through the rear opening 164 of the inner cavity 162 and into the inner cavity 162.

Figure 16:
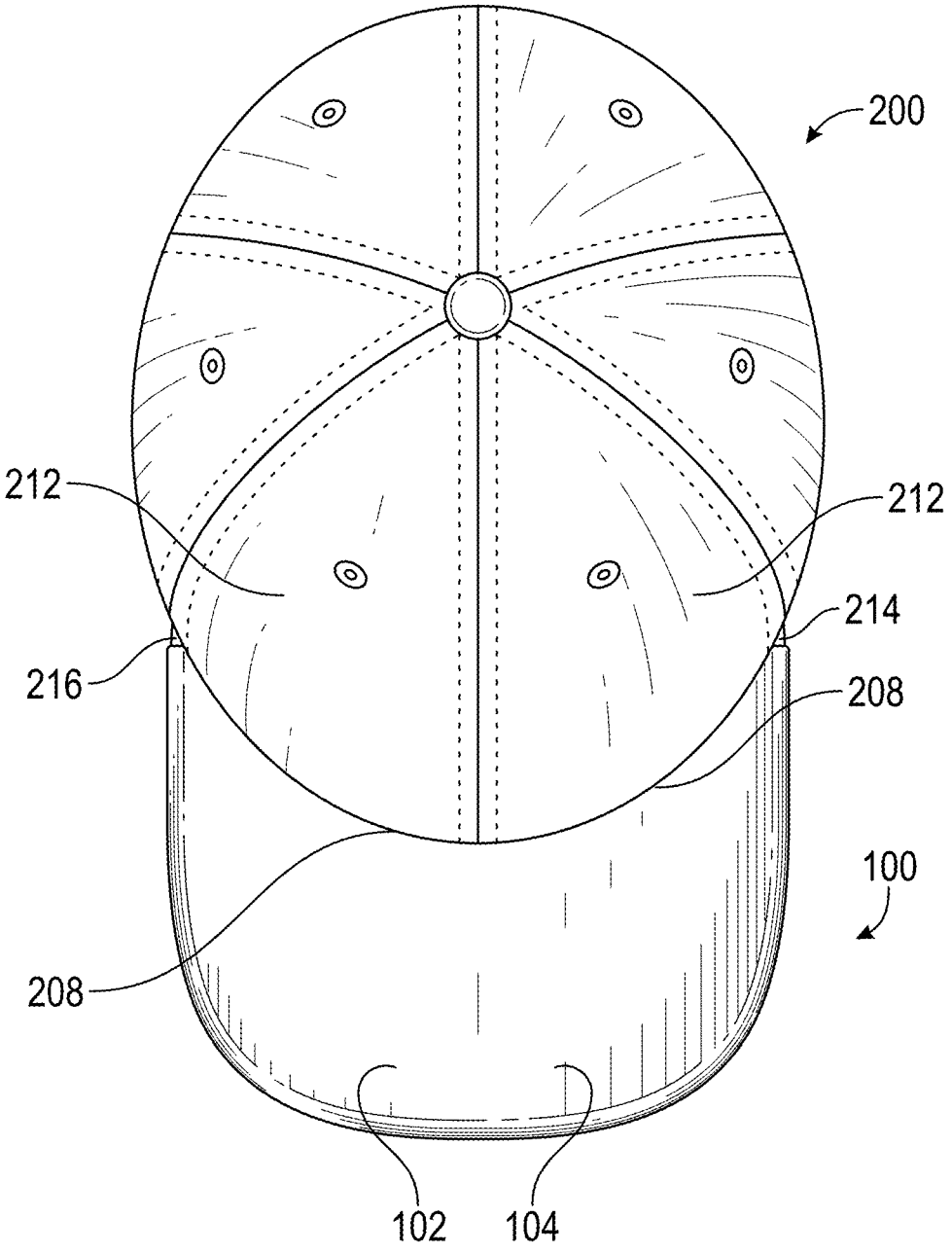
FIG. 16 is a top plan view of the wearable brim shaper shown in FIGS. 1-9 and 15, illustrating the wearable brim shaper installed on the brim of the ball cap shown in FIG. 15.
Figure 17:
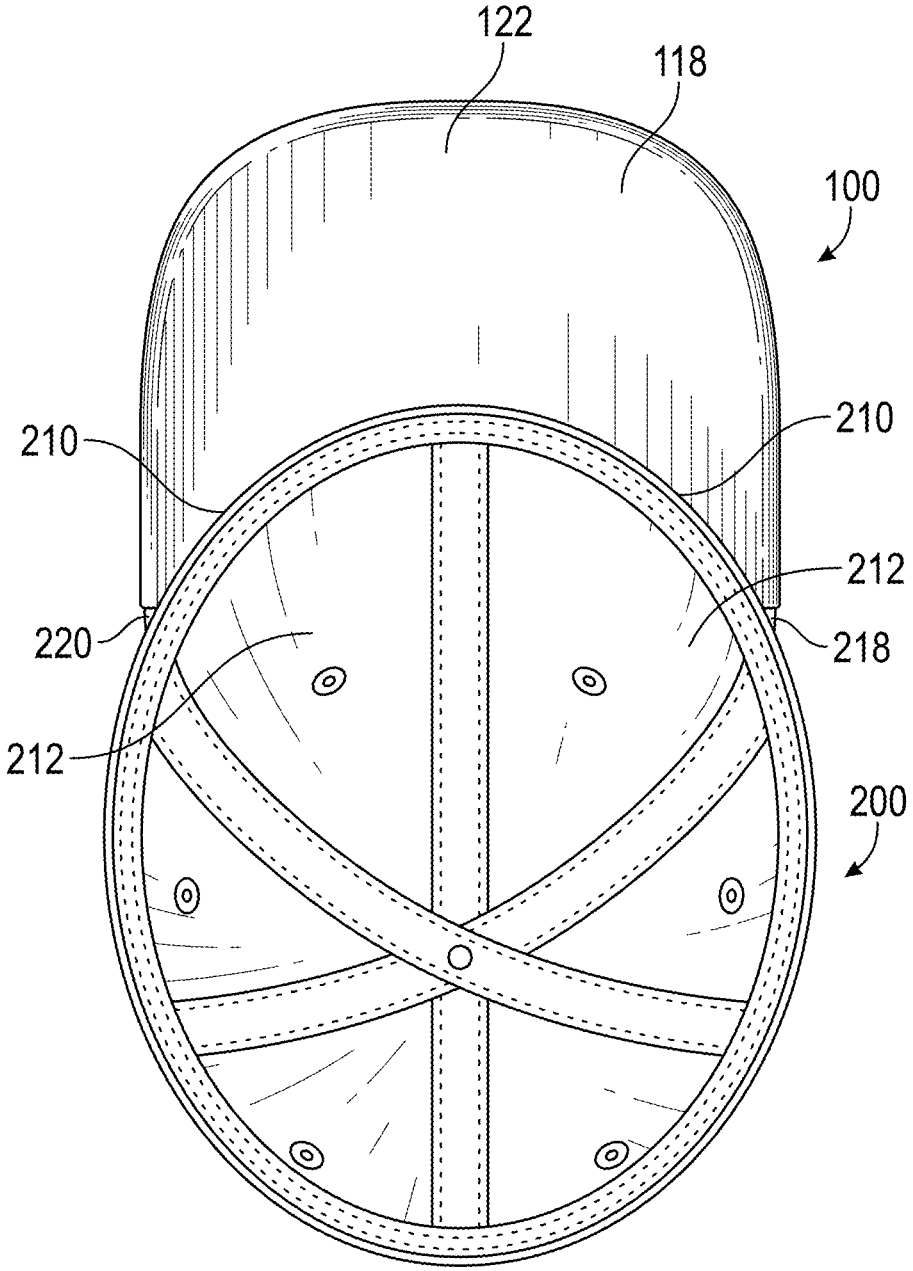
FIG. 17 is a bottom plan view of the wearable brim shaper shown in FIGS. 1-9, 15 and 16, illustrating the wearable brim shaper installed on the brim of the ball cap shown in FIGS. 15 and 16.

As shown in FIGS. 16 and 17, when the wearable brim shaper 100 is installed on the brim 202 of the ball cap 200, at least a front portion 206 of the brim 202 of the ball cap 200 is enclosed within the inner cavity 162.

Figure 18:
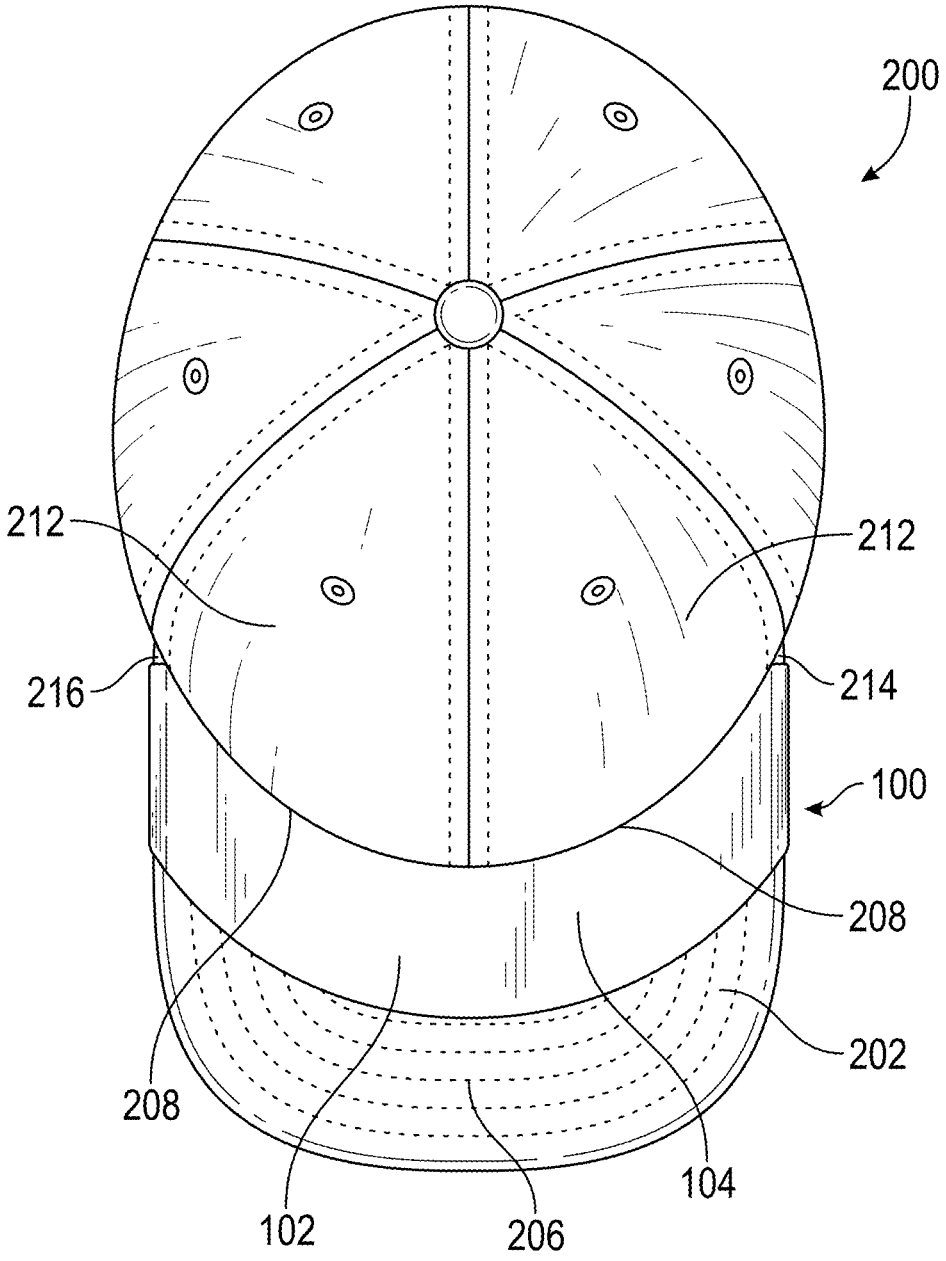
FIG. 18 is a top plan view of the wearable brim shaper shown in FIGS. 10-14, illustrating the wearable brim shaper installed on a brim of a ball cap, such as the ball cap shown in FIG. 15.
Figure 19:
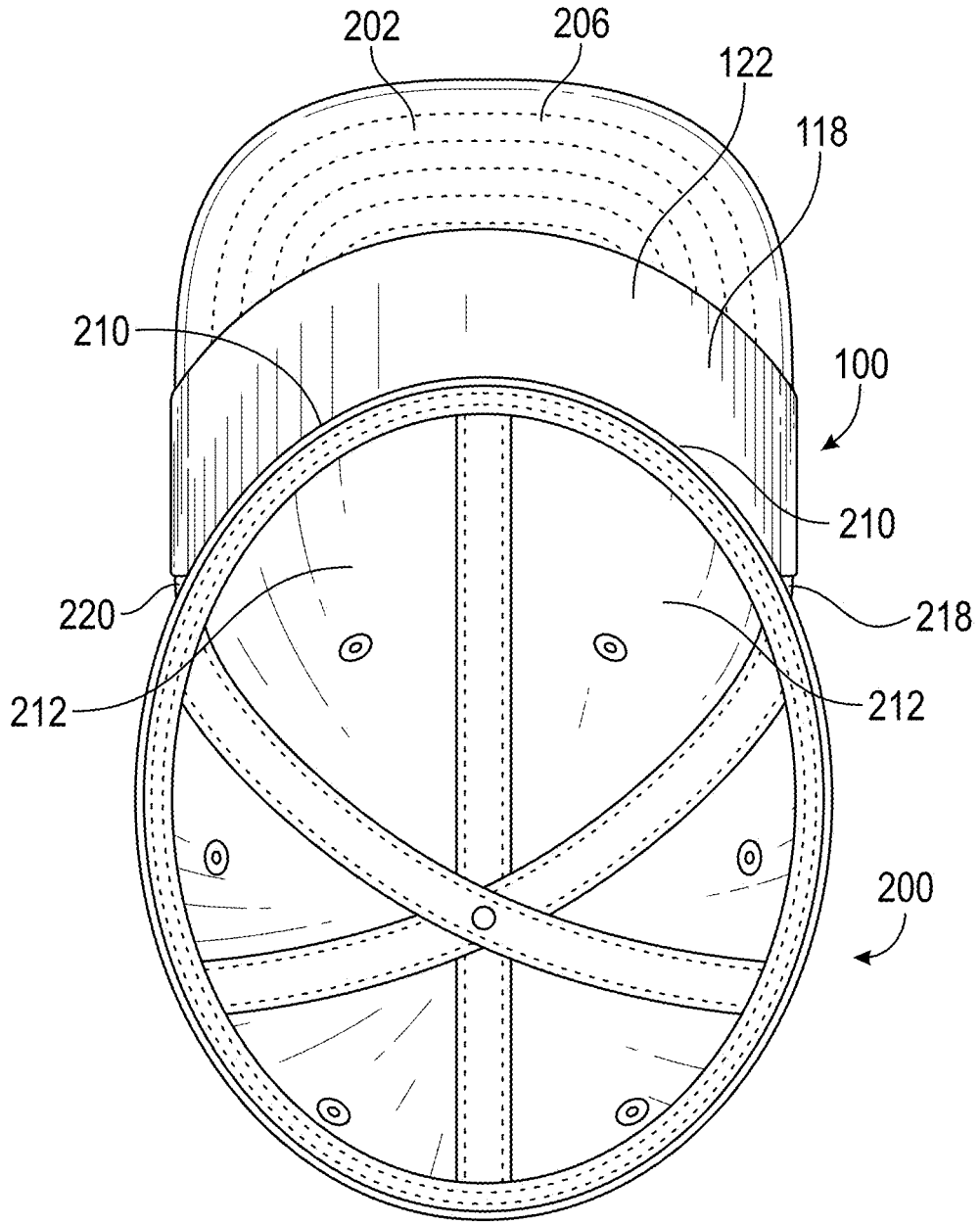
FIG. 19 is a bottom plan view of the wearable brim shaper shown in FIGS. 10-14 and 18, illustrating the wearable brim shaper installed on the brim of the ball cap shown in FIG. 18.

Alternatively, as shown in FIGS. 18 and 19, when the wearable brim shaper 100 is installed on the brim 202 of the ball cap 200, at least the front portion 206 of the brim 202 of the ball cap 200 extends forwardly of the inner cavity 162 and is exposed outside of the inner cavity 162.

In either of the installations of the wearable brim shaper 100 as described above, since the wearable brim shaper 100 is advantageously rigid and lightweight, it is advantageously capable of remaining on the brim 202 of the ball cap 200 to be worn after installation. Additionally, as shown in FIGS. 16-19, since the central curved segment 112 of the rear edge 108 of the top wall 102 and the central curved segment 128 of the rear edge 124 of the bottom wall 118 advantageously diverge from each other, as previously described herein, the wearable brim shaper 100 is advantageously capable of fitting properly and tightly against and around respective curved top and bottom seams 208, 210 of the ball cap 200 defined where the brim 202 of the ball cap 200 intersects with a front crown 212 of the ball cap 200. Moreover, as shown in FIGS. 16-19, the overall geometry and coplanar alignment of the respective left and right U-shaped rear edges 144, 158 of the wearable brim shaper 100, including at least the respective flat or substantially flat U-shaped rear edge surfaces 146, 160 of the left and right U-shaped rear edges 144, 158, advantageously provides greater comfort to a user while wearing the wearable brim shaper 100 on the brim 202 of the ball cap 200. More specifically, since the wearable brim shaper 100 includes the respective left and right U-shaped rear edges 144, 158, including at least the respective flat or substantially flat U-shaped rear edge surfaces 146, 160 thereof, sharp or pointed edges are not present on the wearable brim shaper 100 to curve inwardly toward the user's head (i.e., see respective top and bottom small exposed portions 214, 216, 218, 220 of the rear portion 204 of the brim 202 shown in FIGS. 16-19), thereby avoiding causing possible discomfort by pressing against the user's head while wearing the ball cap 200. Furthermore, the overall geometry and coplanar alignment of the respective left and right U-shaped rear edges 144, 158 of the wearable brim shaper 100, including at least the respective flat or substantially flat U-shaped rear edge surfaces 146, 160 of the left and right U-shaped rear edges 144, 158, also advantageously enables easier removal of the wearable brim shaper 100 from the brim 202 of the ball cap 200. More specifically, the flat or substantially flat U-shaped rear edge surfaces 146, 160 of the respective left and right U-shaped rear edges 144, 158 advantageously provides the user sufficient edges to press against, such as with the user's thumbs, to more easily remove the rigid and tightly-fitted wearable brim shaper 100 from the brim 202 of the ball cap 200.

While one or more embodiments are described above, it is not intended that the one or more embodiments describe all possible forms encompassed by the claims. The words used in the specification are words of description rather than limitation, and it is understood that various changes may be made without departing from the spirit and scope of the disclosure. As previously described herein, the features of various embodiments may be combined to form further embodiments of the disclosure that may not be explicitly described or illustrated. While various embodiments could have been described as providing advantages or being preferred over other embodiments or prior art implementations with respect to one or more desired characteristics, those skilled in the art will recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

With regard to any processes, systems, methods, heuristics, etc., described herein, it should be understood that, although the steps of such processes, etc., have been described as occurring according to a certain ordered sequence, such processes could be practiced with the described steps performed in an order other than the order described herein. It should be further understood that certain steps could be performed simultaneously, that other steps could be added, or that certain steps described herein could be omitted. In other words, the descriptions of any processes described above are provided for the purpose of illustrating certain embodiments, and should in no way be construed so as to limit the claims.

As used in this specification and claims, the terms "for example"/("e.g."), "for instance", "such as", and "like", and the verbs "comprising", "having", "including", and their other verb forms, when used in conjunction with a listing of one or more carriers or other items, are each to be construed as open-ended, meaning that the listing is not to be considered as excluding other, additional carriers or items. Other terms are to be construed using their broadest reasonable meaning unless they are used in a context that requires a different interpretation.

What is claimed is:

1. A wearable brim shaper for a ball cap, the ball cap including at least a front crown and a brim having a rear portion and a front portion, the rear portion of the brim intersecting the front crown, the wearable brim shaper comprising:

a top wall having a top surface that curves at least downwardly, an opposing bottom surface that curves at least downwardly, and a rear edge defined between at least the top and bottom surfaces of the top wall, the rear edge having a central curved segment that curves at least downwardly and rearwardly, the rear edge further having a left curved segment that curves downwardly but not rearwardly, the left curved segment merging with the central curved segment at a first intersection, the rear edge further having a right curved segment that curves downwardly but not rearwardly, the right curved segment merging with the central curved segment at a second intersection;

a bottom wall having a top surface that curves at least downwardly, an opposing bottom surface that curves at least downwardly, and a rear edge defined between at least the top and bottom surfaces of the bottom wall, the rear edge of the bottom wall having a central curved segment that curves at least downwardly and rearwardly, the rear edge of the bottom wall further having a left curved segment that curves downwardly but not rearwardly, the left curved segment of the rear edge of the bottom wall merging with the central curved segment of the rear edge of the bottom wall at a third intersection, the rear edge of the bottom wall further having a right curved segment that curves downwardly but not rearwardly, the right curved segment of the rear edge of the bottom wall merging with the central curved segment of the rear edge of the bottom wall at a fourth intersection;

a left sidewall having an outer surface, an opposing inner surface, and a rear edge defined between at least the outer and inner surfaces of the left sidewall, the left sidewall merging with the top wall and the bottom wall such that the rear edge of the left sidewall, the left curved segment of the rear edge of the top wall, and the left curved segment of the rear edge of the bottom wall together form a left U-shaped rear edge of the wearable brim shaper that terminates at the respective first and third intersections;

a right sidewall having an outer surface, an opposing inner surface, and a rear edge defined between at least the outer and inner surfaces of the right sidewall, the right sidewall merging with the top wall and the bottom wall such that the rear edge of the right sidewall, the right curved segment of the rear edge of the top wall, and the right curved segment of the rear edge of the bottom wall together form a right U-shaped rear edge of the wearable brim shaper that terminates at the respective second and fourth intersections; and an inner cavity defined between at least the bottom surface of the top wall, the top surface of the bottom wall, the inner surface of the left sidewall, and the inner surface of the right sidewall, the inner cavity having a rear opening defined between at least the respective rear edges of the top wall, the bottom wall, the left sidewall, and the right sidewall, the rear opening being shaped and sized to allow the brim of the ball cap to extend therethrough;

wherein a center axis of the wearable brim shaper extends in a front-to-rear direction of the wearable brim shaper;

wherein, in at least a top plan view of the wearable brim shaper, a left portion of the central curved segment of the rear edge of the top wall and a left portion of the central curved segment of the rear edge of the bottom wall converge at the center axis and diverge rearwardly with respect to each other from the center axis of the wearable brim shaper to the respective first and third intersections;

wherein, in at least the top plan view of the wearable brim shaper, a right portion of the central curved segment of the rear edge of the top wall and a right portion of the central curved segment of the rear edge of the bottom wall converge at the center axis and diverge rearwardly with respect to each other from the center axis of the wearable brim shaper to the respective second and fourth intersections; and wherein the wearable brim shaper is installable on the brim of the ball cap such that, when the wearable brim shaper is installed on the brim of the ball cap, at least the rear portion of the brim of the ball cap extends through the rear opening of the inner cavity and into the inner cavity.

2. The wearable brim shaper according to claim 1, further comprising a front sidewall having an outer surface and an opposing inner surface, the front sidewall merging with the top wall, the bottom wall, the left sidewall, and the right sidewall.

3. The wearable brim shaper according to claim 2, wherein the inner cavity is further defined between at least the bottom surface of the top wall, the top surface of the bottom wall, the inner surface of the left sidewall, the inner surface of the right sidewall, and the inner surface of the front sidewall, and wherein when the wearable brim shaper is installed on the brim of the ball cap, at least the front portion of the brim of the ball cap is enclosed within the inner cavity.

4. The wearable brim shaper according to claim 1, wherein the top wall further has a front edge defined between at least the top and bottom surfaces of the top wall, the front edge curving at least downwardly and rearwardly, wherein the bottom wall further has a front edge defined between at least the top and bottom surfaces of the bottom wall, the front edge of the bottom wall curving at least downwardly and rearwardly, wherein the left sidewall further has a front edge defined between at least the outer and inner surfaces of the left sidewall, and wherein the right sidewall further has a front edge defined between at least the outer and inner surfaces of the right sidewall.

5. The wearable brim shaper according to claim 4, wherein the inner cavity further has a front opening defined between at least the front edges of the top wall, the bottom wall, the left sidewall, and the right sidewall, the front opening being shaped and sized to allow the brim of the ball cap to extend therethrough such that, when the wearable brim shaper is installed on the brim of the ball cap, at least the front portion of the brim of the ball cap extends forwardly of the inner cavity and outside of the inner cavity.

6. The wearable brim shaper according to claim 1, wherein the top wall further has a cross-sectional wall thickness defined between the top and bottom surfaces of the top wall, wherein the bottom wall further has a cross-sectional wall thickness defined between the top and bottom surfaces of the bottom wall, wherein the left sidewall further has a cross-sectional wall thickness defined between the outer and inner surfaces of the left sidewall, wherein the right sidewall further has a cross-sectional wall thickness defined between the outer and inner surfaces of the right sidewall, and wherein each of the cross-sectional wall thicknesses of the top wall, the bottom wall, the left sidewall, and the right sidewall is 2 millimeters or less.

7. The wearable brim shaper according to claim 1, wherein the wearable brim shaper is rigid such that the wearable brim shaper maintains is overall shape of the wearable brim shaper when installed on the brim of the ball cap or when not installed on the brim of the ball cap.

8. A wearable brim shaper for a ball cap, the ball cap including at least a front crown and a brim having a rear portion and a front portion, the rear portion of the brim intersecting the front crown, the wearable brim shaper comprising:

a curved top wall having a top surface that curves at least downwardly, an opposing bottom surface that curves at least downwardly, and a rear edge having a rear edge surface defined between at least the top and bottom surfaces of the curved top wall, the rear edge further having a central curved segment that curves at least downwardly and rearwardly, the rear edge further having a left curved segment that curves downwardly, the left curved segment merging with the central curved segment at a first intersection, the rear edge further having a right curved segment that curves downwardly, the right curved segment merging with the central curved segment at a second intersection;

a curved bottom wall having a top surface that curves at least downwardly, an opposing bottom surface that curves at least downwardly, and a rear edge having a rear edge surface defined between at least the top and bottom surfaces of the curved bottom wall, the rear edge of the curved bottom wall further having a central curved segment that curves at least downwardly and rearwardly, the rear edge of the curved bottom wall further having a left curved segment that curves downwardly, the left curved segment of the rear edge of the curved bottom wall merging with the central curved segment of the rear edge of the curved bottom wall at a third intersection, the rear edge of the curved bottom wall further having a right curved segment that curves downwardly, the right curved segment of the rear edge of the curved bottom wall merging with the central curved segment of the rear edge of the curved bottom wall at a fourth intersection;

a curved left sidewall having an outer surface that is curved, an opposing inner surface that is curved, and a rear edge having a rear edge surface defined between at least the outer and inner surfaces of the curved left sidewall, the curved left sidewall merging with the curved top wall and the curved bottom wall such that the rear edge of the curved left sidewall, the left curved segment of the rear edge of the curved top wall, and the left curved segment of the rear edge of the curved bottom wall are coplanar with respect to each other;

a curved right sidewall having an outer surface that is curved, an opposing inner surface that is curved, and a rear edge having a rear edge surface defined between at least the outer and inner surfaces of the curved right sidewall, the curved right sidewall merging with the curved top wall and the curved bottom wall such that the rear edge of the curved right sidewall, the right curved segment of the rear edge of the curved top wall, and the right curved segment of the rear edge of the curved bottom wall are coplanar with respect to each other; and an inner cavity defined between at least the bottom surface of the curved top wall, the top surface of the curved bottom wall, the inner surface of the curved left sidewall, and the inner surface of the curved right sidewall, the inner cavity having a rear opening defined between at least the respective rear edges of the curved top wall, the curved bottom wall, the curved left sidewall, and the curved right sidewall, the rear opening being shaped and sized to allow the brim of the ball cap to extend therethrough;

wherein a center axis of the wearable brim shaper extends in a front-to-rear direction of the wearable brim shaper;

wherein, in at least a top plan view of the wearable brim shaper, a left portion of the central curved segment of the rear edge of the curved top wall and a left portion of the central curved segment of the rear edge of the curved bottom wall converge at the center axis and diverge rearwardly with respect to each other from the center axis of the wearable brim shaper to the respective first and third intersections;

wherein, in at least the top plan view of the wearable brim shaper, a right portion of the central curved segment of the rear edge of the curved top wall and a right portion of the central curved segment of the rear edge of the curved bottom wall converge at the center axis and diverge rearwardly with respect to each other from the center axis of the wearable brim shaper to the respective second and fourth intersections; and wherein the wearable brim shaper is installable on the brim of the ball cap such that, when the wearable brim shaper is installed on the brim of the ball cap, at least the rear portion of the brim of the ball cap extends through the rear opening of the inner cavity and into the inner cavity.

9. The wearable brim shaper according to claim 8, further comprising a curved front sidewall having an outer surface that is curved and an opposing inner surface that is curved, the curved front sidewall merging with the curved top wall, the curved bottom wall, the curved left sidewall, and the curved right sidewall.

10. The wearable brim shaper according to claim 9, wherein the inner cavity is further defined between at least the bottom surface of the curved top wall, the top surface of the curved bottom wall, the inner surface of the curved left sidewall, the inner surface of the curved right sidewall, and the inner surface of the curved front sidewall, and wherein when the wearable brim shaper is installed on the brim of the ball cap, at least the front portion of the brim of the ball cap is enclosed within the inner cavity.

11. The wearable brim shaper according to claim 8, wherein the curved top wall further has a front edge having a front edge surface defined between at least the top and bottom surfaces of the curved top wall, the front edge curving at least downwardly and rearwardly, wherein the curved bottom wall further has a front edge having a front edge surface defined between at least the top and bottom surfaces of the curved bottom wall, the front edge of the bottom wall curving at least downwardly and rearwardly, wherein the curved left sidewall further has a front edge having a front edge surface defined between at least the outer and inner surfaces of the curved left sidewall, and wherein the curved right sidewall further has a front edge having a front edge surface defined between at least the outer and inner surfaces of the curved right sidewall.

12. The wearable brim shaper according to claim 11, wherein the inner cavity further has a front opening defined between at least the front edges of the curved top wall, the curved bottom wall, the curved left sidewall, and the curved right sidewall, the front opening being shaped and sized to allow the brim of the ball cap to extend therethrough such that, when the wearable brim shaper is installed on the brim of the ball cap, at least the front portion of the brim of the ball cap extends forwardly of the inner cavity and outside of the inner cavity.

13. The wearable brim shaper according to claim 8, wherein the left curved segment of the rear edge of the curved top wall does not curve rearwardly, wherein the right curved segment of the rear edge of the curved top wall does not curve rearwardly, wherein the left curved segment of the rear edge of the curved bottom wall does not curve rearwardly, wherein the right curved segment of the rear edge of the curved bottom wall does not curve rearwardly, wherein the curved left sidewall merges with the curved top wall and the curved bottom wall such that the rear edge of the curved left sidewall, the left curved segment of the rear edge of the curved top wall, and the left curved segment of the rear edge of the curved bottom wall together form a left U-shaped rear edge of the wearable brim shaper that terminates at the respective first and third intersections, and wherein the curved right sidewall merges with the curved top wall and the curved bottom wall such that the rear edge of the curved right sidewall, the right curved segment of the rear edge of the curved top wall, and the right curved segment of the rear edge of the curved bottom wall together form a right U-shaped rear edge of the wearable brim shaper that terminates at the respective second and fourth intersections.

14. The wearable brim shaper according to claim 13, wherein, in at least the top plan view of the wearable brim shaper, the left U-shaped rear edge, the right U-shaped rear edge, the first intersection, the second intersection, the third intersection, and the fourth intersection are coplanar with respect to each other in a vertical plane that is perpendicular to the center axis of the wearable brim shaper.

15. The wearable brim shaper according to claim 8, wherein, in at least the top plan view of the wearable brim shaper, the curved top wall overlaps the curved bottom wall such that portions of the top surface of the curved bottom wall that are disposed inside of the inner cavity are visible, and wherein, in at least a bottom plan view of the wearable brim shaper, the curved bottom wall overlaps the curved top wall such that an entirety of the bottom surface of the curved top wall is hidden from view.

16. The wearable brim shaper according to claim 8, wherein the curved top wall further has a cross-sectional wall thickness defined between the top and bottom surfaces of the curved top wall, wherein the curved bottom wall further has a cross-sectional wall thickness defined between the top and bottom surfaces of the curved bottom wall, wherein the curved left sidewall further has a cross-sectional wall thickness defined between the outer and inner surfaces of the curved left sidewall, wherein the curved right sidewall further has a cross-sectional wall thickness defined between the outer and inner surfaces of the curved right sidewall, and wherein each of the cross-sectional wall thicknesses of the curved top wall, the curved bottom wall, the curved left sidewall, and the curved right sidewall is 2 millimeters or less.

17. The wearable brim shaper according to claim 8, wherein the wearable brim shaper is rigid such that the wearable brim shaper maintains its overall shape of the wearable brim shaper when installed on the brim of the ball cap or when not installed on the brim of the ball cap.

18. A wearable brim shaper for a ball cap, the ball cap including at least a front crown and a brim having a rear portion and a front portion disposed forward of the rear portion, the rear portion of the brim intersecting the front crown, the wearable brim shaper comprising:

a top wall that is curved, the top wall having a rear edge;

a bottom wall that is curved, the bottom wall having a rear edge;

a left sidewall that is curved, the left sidewall having a rear edge, the left sidewall merging with the top and bottom walls such that the rear edges of the respective left sidewall, the top wall, and the bottom wall together form a left U-shaped rear edge of the wearable brim shaper, the left U-shaped rear edge having a left flat U-shaped rear edge surface;

a right sidewall that is curved, the right sidewall having a rear edge, the right sidewall merging with the top and bottom walls such that the rear edges of the respective right sidewall, the top wall, and the bottom wall together form a right U-shaped rear edge of the wearable brim shaper, the right U-shaped rear edge having a right flat U-shaped rear edge surface; and an inner cavity defined between at least the top and bottom walls and the left and right sidewalls, the inner cavity having a rear opening defined between at least the respective rear edges of the top wall, the bottom wall, the left sidewall, and the right sidewall, the rear opening being shaped and sized to allow the brim of the ball cap to extend therethrough;

wherein a center axis of the wearable brim shaper extends in afront-to-rear direction of the wearable brim shaper;

wherein, in at least a top plan view of the wearable brim shaper, an entirety of the left flat U-shaped rear edge surface and an entirety of the right flat U-shaped rear edge surface are coplanar with respect to each other in a vertical plane that is perpendicular to the center axis of the wearable brim shaper;

wherein, in at least the top plan view of the wearable brim shaper, a left curved portion of the rear edge of the top wall and a left curved portion of the rear edge of the bottom wall converge at the center axis and diverge rearwardly with respect to each other from the center axis of the wearable brim shaper;

wherein, in at least the top plan view of the wearable brim shaper, a right curved portion of the rear edge of the top wall and a right curved portion of the rear edge of the bottom wall converge at the center axis and diverge rearwardly with respect to each other from the center axis of the wearable brim shaper;

wherein the wearable brim shaper is installable on the brim of the ball cap such that, when the wearable brim shaper is installed on the brim of the ball cap, at least the rear portion of the brim of the ball cap extends through the rear opening of the inner cavity and into the inner cavity; and wherein the wearable brim shaper is rigid such that the wearable brim shaper maintains overall shape of the wearable brim shaper when installed on the brim of the ball cap or when not installed on the brim of the ball cap.

19. The wearable brim shaper according to claim 18, wherein, in at least the top plan view of the wearable brim shaper, the top wall overlaps the bottom wall such that portions of a top surface of the bottom wall that are disposed inside of the inner cavity are visible, and wherein, in at least a bottom plan view of the wearable brim shaper, the bottom wall overlaps the top wall such that portions of a bottom surface of the top wall that are disposed inside of the inner cavity are hidden from view.

* * * * *